US006696236B2

(12) United States Patent
Nakahira et al.

(10) Patent No.: US 6,696,236 B2
(45) Date of Patent: Feb. 24, 2004

(54) SILVER HALIDE EMULSION AND SILVER HALIDE PHOTOSENSITIVE MATERIAL

(75) Inventors: Shinichi Nakahira, Kanagawa (JP); Tatsuya Ishizaka, Kanagawa (JP)

(73) Assignee: Fuji Photo Film Co. Ltd., Kanagawa (JP)

( * ) Notice: Subject to any disclaimer, the term of this patent is extended or adjusted under 35 U.S.C. 154(b) by 37 days.

(21) Appl. No.: 09/993,509

(22) Filed: Nov. 27, 2001

(65) Prior Publication Data

US 2002/0102505 A1 Aug. 1, 2002

(30) Foreign Application Priority Data

Nov. 27, 2000 (JP) ..... 2000-360118
Dec. 7, 2000 (JP) ..... 2000-373287

(51) Int. Cl.[7] ..... G03C 1/005; G03C 1/494

(52) U.S. Cl. ..... 430/567; 430/599; 430/604; 430/605

(58) Field of Search ..... 430/567, 599, 430/604, 605

(56) References Cited

U.S. PATENT DOCUMENTS 5,108,877 A * 4/1992 Asami ..... 430/567
5,153,110 A * 10/1992 Kawai et al. ..... 430/567
5,284,743 A 2/1994 Ohshima et al.
5,360,712 A 11/1994 Olm et al.
5,457,021 A * 10/1995 Olm et al. ..... 430/605
5,462,849 A 10/1995 Kuromoto et al.
5,783,373 A 7/1998 Mydlarz et al.
5,783,378 A 7/1998 Mydlarz et al.
6,107,018 A * 8/2000 Mydlarz et al. ..... 430/605
6,183,946 B1 2/2001 Ochiai

FOREIGN PATENT DOCUMENTS

EP 1 030 215 A 8/2000

OTHER PUBLICATIONS

Patent Abstracts of Japan, vol. 2000, No. 01 Jan. 31, 2000 for JP–A 11–295837.

* cited by examiner

*Primary Examiner*—Geraldine Letscher
(74) *Attorney, Agent, or Firm*—Sughrue Mion, PLLC

(57) ABSTRACT

Disclosed are a silver halide emulsion and a silver halide photosensitive material copmrising a support and at least one photosensitive layer comprising the silver halide emulsion. The photosensitive emulsion comprises silver halide grains, wherein the silver chloride content is 90 mole % or more; the silver halide grains contain (I) at least one member of a six-coordinated complex in which iridium (Ir) is a central metal having halogen atom and O, $H_2O$, thiazole or substituted thiazole as ligands and (II) at least one member of a six-coordinated complex in which iridium (Ir) is a central metal having halogen atom as a ligand; and the iridium compound (II) is present in a localized silver bromide phase.

26 Claims, No Drawings

SILVER HALIDE EMULSION AND SILVER HALIDE PHOTOSENSITIVE MATERIAL

BACKGROUND OF THE INVENTION

1. Field of the Invention

The present invention relates to a silver halide emulsion and also to a silver halide photographic material using the same. More particularly, it relates to a silver halide emulsion which has an excellent processing speed, which obeys the reciprocity rule at high-intensity exposure and which has an excellent stability between the time of preparation of a coating solution until the time of coating, and also relates to a silver halide photosensitive material using the same. Further, the present invention relates to a silver halide emulsion and a silver halide color photosensitive material using the same which do not exhibit a high intensity reciprocity low failure and which can bring about a high contrast image, even in the case of a digital exposure such as a laser scanning exposure.

2. Description of the Related Art

As the use of digital cameras and personal computers has become widespread in recent years, frequency of use of a silver halide photosensitive material as a material for printing of digital image information too is increasing. As a material for printing of digital image information, an image output material other than a silver halide photosensitive material, typically an ink jet printer paper, has become popular. In order to keep up with such a material, there has been an increasingly strong demand for quicker development processing steps, higher image quality, more stable processing, etc. for silver halide photosensitive materials such as color printing paper.

An exposing means for printing of digital image information on a silver halide photographic material, has been commonly carried out by subjecting a silver halide photosensitive material to a scanning exposure with light using a light beam such as laser beam modified on the basis of the image information. In order to print within a shorter time, it is necessary to make the exposure time for each pixel short and thus there is a demand for a silver halide photographic material showing a favorable response to exposures of shorter time and of higher light intensity. Thus, there is a further demand for a silver halide photosensitive material where the so-called failure of the reciprocity rule at high intensity is less.

In order to prevent failure of the reciprocity rule at high light intensities, a method where a metal compound represented by iridium is doped on substrate grains is well known in the art.

Prevention of the failure of the reciprocity rule of silver halide emulsion using iridium is described, for example, in B. H. Carroll, "Iridium Sensitization: A Literature Review", *Photographic Science and Engineering*, Vol. 24, No. 6, 1980 and R. S. Eachus, "The Mechanism for $Ir^{3+}$ Sensitization" (International Congress on Photographic Science, 1982).

On the other hand, it is also known that a silver halide emulsion to which iridium is added shows a very unfavorable characteristic in that the photographic property (such as sensitivity and gradation) changes in accordance with the time that elapses until the post exposure processing is carried out. The characteristic is described in H. zwicky's, "On the Mechanism of the Sensitivity Increase with Iridium in Silver Halide Emulsions", *The Journal of Photographic Science*, Vol. 33, pages 201–203, 1985.

Although reciprocity failure a result of high light intensity has been significantly mitigated by the conventional methods, variations in the sensitivity with the changes in the time until the post exposure processing is carried out become significantly large and, therefore, such methods are not practical.

In an attempt to solve the problems of sensitivity variation with changes in the time until the post exposure processing is carried out by preventing reciprocity failure due to high intensities, there is disclosed a method where a metal compound represented by iridium is doped with grains containing high amount of silver halide in a localized silver bromide phase in the U.S. Pat. Nos. 5,391,471, 5,041,599, 5,043,256 and 5,627,020.

Further, in the Japanese Patent Laid-Open No. 7-34103, there is disclosed an art where an iridium compound is introduced into silver halide grains together with formation of a local phase containing a high amount of silver bromide.

Furthermore, in the Japanese Patent Laid-Open No. 11-109534, it is disclosed that, in a silver halide emulsion having a local silver bromide phase containing an iridium compound near silver halide grains, a high density area of the iridium compound is formed in the inner side of the local silver bromide phase whereby the above-mentioned problem is improved.

However, as a result of the investigation of the present inventors, improvement of the emulsion obtained by the above-mentioned art is not sufficient and, especially when the temperature at the exposure is low, stability of sensitivity and gradation with respect to variations in the time until the post exposure processing is carried out has been found to be still insufficient and there has been a demand for the development of the means for solving this problem.

In addition, it has been known that an iridium-doped silver chloride emulsion causes a latent image sensitization in a short period of time after exposure. For example, Japanese Patent Publication No. 7-34103 discloses that a localized phase (site) which has a high silver bromide content in which iridium is doped so that problems in the latent image sensitization can be solved. The silver halide emulsion prepared by this method can provide a high sensitivity and high contrast of an image even in a relatively high illumination intensity exposure at about 1/100 second, and does not cause problems in the latent image sensitization. However, it has been found that when a high sensitivity is required at an extremely high illumination intensity exposure to the extent about 1 $\mu$second, which is required for a digital exposure method using a laser scanning exposure, a high contrast of an image cannot be obtained.

U.S. Pat. No. 5,691,119 discloses a method for preparing an emulsion containing silver halide grains having a localized phase (site) having a high content of silver bromide, and describes that the emulsion brings about a high contrast under a high illumination intensity. However, there are drawbacks that such effect is not satisfactory and the reproducibility of performances of the emulsions prepared repeatedly by this method is poor.

U.S. Pat. Nos. 5,783,373 and 5,783,378 disclose that a high illumination reciprocity law failure is reduced and a high contrast can be obtained by the use of at least three types of dopants. However, the high contrast is obtained by using the dopants having desensitizing and contrast enhancement functions, so that this method is not compatible with the sensitivity enhancement.

U.S. Pat. Nos. 5,726,005 and 5,736,310 disclose that an emulsion containing grains which have a maximum concentration of iodine on the surface of silver chloride emulsion to obtain an emulsion having a high sensitivity and a less high illumination reciprocity low failure. However, a higher sensitivity can be obtained with a higher illumination intensity, but the gradation of this emulsion is extremely low so that it is not suitable for digital exposure having a limited dynamic range of light amount.

As described above, a silver halide color photographic photosensitive material (silver halide emulsion) which can provide a high sensitivity without a high illumination intensity reciprocity failure and with a less latent image sensitization and which is capable of forming a high contrast image has not been yet obtained.

SUMMARY OF THE INVENTION

The invention is to solve the above-mentioned conventional problems and to achieve the following object.

Thus, the present invention is to provide a silver halide emulsion showing excellent processing speed, little reciprocity failure upon a high-intensity exposure and little change in sensitivity when the time from exposure until development changes, and which is unaffected by temperature upon exposure to light. The object is also to provide a silver halide photosensitive material using this emulsion.

Further, an object of the present invention is to provide a silver halide emulsion which does not exhibit a high illumination intensity reciprocity law failure at a extremely high illumination intensity exposure (digital exposure) such as a laser scanning exposure and which is capable of forming a high contrast developed color gradation with a high sensitivity with a less latent image sensitization.

Still further, an object of the present invention is to provide a silver halide color photographic photosensitive material which does not exhibit a high illumination intensity reciprocity law failure at a extremely high illumination intensity exposure (digital exposure) such as laser scanning exposure and which is capable of forming a high contrast image with a high sensitivity and a high contrast image constantly with a superior image stability after exposure.

In the first embodiment, the invention is a silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by formula (I), (ii) the iridium compound (B) is represented by formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I) and (II) being:

Formula (I)

$[Ir\ (Y)_n(Xa)_m]^l$ wherein Xa is a halogen atom; Y is O, $H_2O$, thiazole or substituted thiazole; and l, m and n are integers selected from ranges of from −2 to +3, from 1 to 5 and from 1 to 5, respectively and;

Formula (II)

$[Ir\ (Xb)_6]^p$ wherein Xb is a halogen atom; and p is an integer selected from a range of from −2 to −3.

In one aspect of the first embodiment, the present invention preferably relates to the silver halide emulsion wherein the molar ratio [(I)/(II)] of the iridium compound represented by the formula (I) to the iridium compound represented by the formula (II) is 0.25–10.

In another aspect of the first embodiment, the present invention preferably relates to the silver halide emulsion wherein Y in the iridium compound represented by the formula (I) is O or $H_2O$.

In the second embodiment, the present invention discloses a silver halide emulsion described in the first embodiment wherein (i), (ii) and (iii) are respectively characterized by following conditions (iv), (v) and (vi):

(iv) the iridium compound (A) is a sixcoordinate complex which has an iridium as a central metal having at least one $H_2O$ as a ligand and is doped to the site where the localized silver chloride content is no less than 90 mole % in the silver halide grains;

(v) the iridium compound (B) is a sixcoordinate complex which has an iridium as a central metal having ligands selected from the group consisting of Cl, Br and I, and is doped to the site where the localized silver bromide content is no less than 40 mole % in the silver halide grains; and (vi) the silver halide grains have a site where the localized silver bromide content is no less than 40 mol %.

In one aspect of the second embodiment, the invention preferably relates to the silver halide emulsion, characterized in that, the site at which the silver bromide content in the silver halide grains is no less than 40 mole % is formed by dissolving and sedimentation of fine grains of silver halide.

In another aspect of the second embodiment, the present invention preferably relates to the silver halide emulsion, characterized in that, the silver halide grains are silver chloride iodide bromide grains containing 0.02 mole % to 1 mole % of silver iodide.

In the third embodiment, the present invention discloses a silver halide photosensitive material comprising a support having disposed thereon at least one layer containing a silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by the formula (I), (ii) the iridium compound (B) is represented by the formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I) and (II) being:

Formula (I)

$[Ir\ (Y)_n(Xa)_m]^l$ wherein Xa is a halogen atom; Y is O, $H_2O$, thiazole or substituted thiazole; and l, m and n are integers selected from ranges of from −2 to +3, from 1 to 5 and from 1 to 5, respectively and;

Formula (II)

$[Ir(Xb)_6]^p$ wherein Xb is a halogen atom; and p is an integer selected from a range of from −2 to −3.

In one aspect of the third embodiment, the invention preferably relates to the silver halide photosensitive material wherein the molar ratio [(I)/(II)] of the iridium compound represented by the formula (I) to the iridium compound represented by the formula (II) is 0.25–10.

In another aspect of the third embodiment, the invention preferably relates to the silver halide photosensitive material wherein Y in the iridium compound represented by the formula (I) is O or $H_2O$.

In the fourth embodiment, the present invention discloses a silver halide photosensitive material described in the third embodiment which comprising at least three layers containing the silver halide emulsion, wherein at least one of the three layers is a yellow dye-forming coupler-containing silver halide emulsion layer, at least one of the three layers is a magenta dye-forming coupler-containing silver halide emulsion layer, and at least one of the three layers is a cyan dye-forming coupler-containing silver halide emulsion layer, and wherein (i), (ii) and (iii) are respectively characterized by following conditions (iv), (v) and (vi):

(iv) the iridium compound (A) is a sixcoordinate complex which has an iridium as a central metal having at least one $H_2O$ as a ligand and is doped to the site where the localized silver chloride content is no less than 90 mole % in the silver halide grains;

(v) the iridium compound (B) is a sixcoordinate complex which has an iridium as a central metal having ligands selected from the group consisting of Cl, Br and I, and is doped to the site where the localized silver bromide content is no less than 40 mole % in the silver halide grains; and (vi) the silver halide grains have a site where the localized silver bromide content is no less than 40 mol %.

In one aspect of the fourth embodiment, the invention preferably relates to the silver halide photosensitive material, characterized in that, the site where the silver bromide content of the silver halide grains is no less than 40 mole % is formed by dissolving and sedimentation of fine grains of silver halide.

In another aspect of the fourth embodiment, the invention preferably relates to the silver halide photosensitive material, characterized in that, the silver halide grains are silver chloride iodide bromide grains containing 0.02 mole % to 1 mole % of silver iodide.

DETAILED DESCRIPTION OF THE PREFERRED EMBODIMENTS

The silver halide emulsion of the present invention is a silver halide emulsion in which silver chloride content in silver halide grains is 90 mole % or more. The silver halide grains has a silver bromide localized phase and is doped with at least two types of iridium compounds. The silver bromide localized phase is doped with iridium compound having a halogen atom as a ligand.

The present invention also relates to a silver halide photographic photosensitive material containing at least one silver halide emulsion as described above. More particularly, the emulsion and photosensitive material as described in the first to fourth embodiments.

First, halide composition of the silver halide grains in the invention will be described.

The silver halide grains in the silver halide emulsion according to the present invention comprises silver chloride bromide or silver chlorobromoiodide which contains 90 mole % or more of silver chloride and has a silver bromide localized phase. It is preferable that the silver halide grains contain silver bromide in light of sensitivity enhancement and hard gradation enhancement. The silver chloride content in the silver halide grains is preferably 95 mole % or more, more preferably 97 mole % or more in view of rapid processing characteristics. The silver halide grains of the present invention contains preferably 0.01 to 1 mole % of silver iodide. In the first and third embodiments in the above, the silver bromide localized phase contains 5 mole % or more of silver in terms of silver amount of the total silver amount of the silver halide grains and is 5 mole % or more of the localized silver bromide content.

In the local halide composition in the localized silver bromide phase, the local silver bromide content is preferably 10 mole % or more and is more preferably 15 mole % or more.

The total amount of bromide ion in the localized silver bromide phase may be freely set within such an extent that the silver chloride content in the total silver halide grains is not lower than 90 mole % although the amount to the total silver halide grains is preferably from 0.5 mole % or more but less than 7 mole % and, more preferably, from 1.0 mole % or more but less than 5.0 mole %.

The ratio of the localized silver bromide phase in terms of the silver amount in the total silver halide grains is preferably from 5 mole % to 25 mole % and, more preferably, from 10 mole % to 20 mole %.

In the second and fourth embodiments, the localized silver bromide phase shall mean the sites where the silver bromide content is 40 mole % or more. The silver bromide content in the silver halide grains is preferably 0.1 to 7 mole %, more preferably, 0.5 to 5 mole %. The localized silver bromide phase contains 5 mole % or less of silver of the total amount of silver in the silver halide grains in terms of silver, preferably, 0.01 to 5 mole %, more preferably, 0.05 to 4 mole %, most preferably, 0.1 to 3 mole %.

In the first embodiment, the localized silver bromide phase in the grains is preferably arranged such that at the side which is outside where the silver amount is more than 50% and, more preferably, more than 70%. Although it is preferred even when the localized silver bromide phase is adjacent to the grain surface, it is also possible to form a low silver bromide-containing phase comprising less than 5 mole % of silver bromide content outside the localized silver bromide phase.

When a low silver bromide-containing phase is formed outside the localized silver bromide phase, it is preferred that the silver amount of the low silver bromide-containing phase is less than 10 mole % of the total silver amount of the silver halide grains.

The localized silver bromide layer may be formed in a layered form surrounding the grains at an inner side or surface of the grains or may be formed in an epitaxial form at the corner of the grain surface. In particular, this is preferred in the second and fourth embodiment of the present invention. In the case of cubes or flat grains where {100} plane is a main surface, the localized silver bromide phase may be formed so as to cover the {100} plane which is the main surface. It is also possible to form a plurality of localized silver bromide phases in the particle. In the first and third embodiments of the present invention, silver iodide content in the silver halide grains preferably 0.01 to 0.5 mole %.

In the second and fourth embodiments of the present invention, the silver iodide content is preferably 0.02–1 mole % and, in view of further increasing sensitivity and contrast at the high-intensity exposure, 0.05–0.50 mole % is more preferred and 0.07–0.40 mole % is still more preferred. In both of the second and fourth embodiments of the present invention, it is preferred that such silver iodide is present near the surface of the silver halide grains.

Next, iridium compounds (A) and (B) of the present invention will be described hereinafter. In the first and third embodiments of the present invention, the iridium compound (A) is represented by the formula (I) and the iridium compound (B) is represented by the formula (II). Namely, the silver halide grains of the invention is further characterized in containing at least one iridium compound represented by the following formula (I) and at least one iridium compound represented by the following formula (II).

Formula (I)

$[Ir\ (Y)_n(Xa)_m]^l$

In the above formula (I), Xa is a halogen atom; Y is O, $H_2O$, thiazole or substituted thiazole; and l, m and n are integers selected from ranges of from −2 to +3, from 1 to 5 and from 1 to 5, respectively.

Formula (II)

$[Ir(Xb)_6]^p$

In the above formula (II), Xb is a halogen atom; and p is an integer selected from a range of from −2 to −3. In the second and fourth embodiments of the present invention, the iridium compound (A) is a sixcoordinate complex which has an iridium as a central metal having at least one $H_2O$ as a ligand, while a sixcoordinate compound (B) which has an iridium as a central metal having one of Cl, Br and I as a ligand.

In the second and fourth embodiments of the present invention, the iridium compound (A) is preferably a sixcoordinate complex which has an iridium as a central metal having at least one $H_2O$ as a ligand and other ligands selected from the group consisting of Cl, Br and I. The iridium compound (A) is more preferably a sixcoordinate complex which has an iridium as a central metal having at least one $H_2O$ as a ligand and Cl atoms as other ligands. Further preferably, in the above formula (I), Y is $H_2O$. In the second and fourth embodiments of the present invention, the iridium compound (B) is preferably a sixcoordinate compound (B) which has an iridium as a central metal having six ligands selected from the group consisting of Cl, Br and I. The iridium compound (B) is more preferably a sixcoordinate complex which has an iridium as a central metal having six ligands selected from one of Cl, Br and I.

As hereunder, specific examples of the iridium compound represented by the iridium compound (A) will be shown although the iridium compound (A) in the present invention is not limited thereto.

$[Ir\ (H_2O)\ Cl_5]^{2-}$ $[Ir\ (H_2O)\ _2Cl_4]^-$ $[Ir\ (H_2O)\ Br\ _5]^{2-}$ $[Ir\ (H_2O)\ _2Br_4]^-$ $[Ir\ (O)Cl_5]^{2-}$ $[Ir\ (O)_2Cl_4]^-$ $[Ir\ (O)Br_5]^{2-}$ $[Ir\ (O)_2Br_4]^-$ $[Ir\ (thiazole)Cl_5]^{2-}$ $[Ir\ (5\text{-methyl thiazole})Cl_5]^{2-}$ $[Ir\ (thiazole)_2Cl_4]^-$ $[Ir\ (5\text{-methylthiazole})_2Cl_4]^-$ $[Ir\ (thiazole)Br_5]^{2-}$ $[Ir\ (thiazole)_2Br_4]^-$ $[Ir(5\text{-methylthiazole})Br_5]^{2-}$ As hereunder, specific examples of the iridium compound (B) will be shown although the iridium compound (B) in the invention is not limited thereto.

$[IrCl_6]^{2-}$ $[IrCl_6]^{3-}$ $[IrBr_6]^{2-}$ $[IrBr_6]^3$ $[IrI_6]^{3-}$

The above-mentioned iridium compounds are anions and, when a salt is formed with a cation, the counter cation is preferably one which is easily soluble in water. To be more specific, an alkaline metal ion such as sodium ion, potassium ion, rubidium ion, cesium ion and lithium ion, ammonium ion or alkylammonium ion is preferred.

Besides water, such a metal complex may be used by dissolving in a mixed solvent of water with an appropriate organic solvent which is miscible with water (such as alcohols, ethers, glycols, ketones, esters and amides).

With regard to the adding amount of the iridium compound (A), $1\times10^{-10}$ to $1\times10^{-3}$ mole per mole of silver halide is preferred, $5\times10^{-8}$ to $\times10^{-5}$ mole per mole silver halide is more preferred and $1\times10^{-7}$ to $5\times10^{-6}$ mole per mole of silver halide is most preferred.

With regard to the adding amount of the iridium compound (B), $1\times10^{-10}$ to $110^{-3}$ mole per mole of silver halide is preferred, $1\times10^{-8}$ to $1\times10^{-5}$ mole per mole of silver halide is more preferred and $5\times10^{-8}$ to $1\times10^{-6}$ mole per mole of silver halide is most preferred.

With regard to the molar ratio [(A)/(B)] (in the first and the third embodiments, [(I)/(II)},) of the adding amount of the iridium compound represented by the iridium compound (A) to the adding amount of the iridium compound represented by the iridium compound (B), from 0.1-to 20-fold is preferred and from 0.25-to 10-fold is more preferred.

In the invention, it is preferred that the iridium compound is directly added to the reaction solution during the formation of the silver halide grains or added to an aqueous solution of a halide for forming the silver halide grains or to another solution and then added to a particle-forming reaction solution so as to be incorporated into the silver halide grains. It is also possible for the iridium compound to be incorporated into the silver halide grains by subjecting the iridium compound to a physical aging using fine grains into which the iridium compound was integrated before hand. It is further possible that the compound is contained in the silver halide grains by combining these methods described above.

When the iridium compound is integrated into the silver halide grains, although it is made uniformly present at the inner side of the grains, it is also preferred that, as disclosed in the Japanese Patent Laid-Open Nos. 4-208936, 2-125245 and 3-188437, the compound is made present only on the surface layer of the particle and it is also preferred that the complex is made present in the inner part of the particle while, on the surface of the particle, a layer containing no complex is added. Further, as shown in the U.S. Pat. Nos. 5,252,451 and 5,256,530, it is also preferred that a physical aging is carried out using fine grains where the complex is integrated into the grains so as to improve the quality of the surface phase of the particle. Furthermore, it is also possible that those methods are used in combination so that plural type of complexes are integrated in one silver halide particle.

With regard to the halogen composition at the position where the complex is contained, although there is no particular limitation for the halogen composition at the position where the iridium compound (A) is contained, presence in the position where the localized silver chloride content is 90 mole % or more is preferred. When the silver chloride content of the position to be doped in silver halide grains is less than 90 mole %, the resulted gradation of photographs tends to de low-contrast. Therefore, doping to the position is defined in the second and fourth embodiments. Further, the iridium compound (B) is comprised in the localized silver bromide phase. It is preferred in the first and third embodiments that at least 50 mole % of the iridium compound (B) is present in a localized silver bromide phase where the localized silver bromide content is 10 mole % or more; it is more preferred that the compound is made present in a localized silver bromide phase where the localized silver bromide content is 20 mole % or more; and it is more preferred that the compound is made present in a localized silver bromide phase where the localized silver bromide content is 40 mole % or more. It is preferred in the second and fourth embodiments that at least 50 mole % of the iridium compound (B) is present in a position (a localized silver bromide phase) where the localized silver bromide content is 40 mole % or more; it is more preferred that the compound is made present in a position (localized silver bromide phase) where the localized silver bromide content is 50 mole % or more; and it is more preferred that the compound is made present in a position (localized silver bromide phase) where the localized silver bromide content is 60 mole % or more.

Formation of the localized silver bromide phase is preferably carried out by addition of a soluble halogen salt containing bromide ion either solely or together with a soluble silver salt to a reactor during the formation of the silver chloride-rich grains. Alternatively, it is also preferably formed by adding a previously prepared fine particle emulsion containing silver bromide either solely or together with a soluble silver salt and/or a soluble halogen salt. In the case of formation of the localized silver bromide phase by means of addition of the previously prepared fine particle emulsion, it is preferred that the silver halide grains in the fine particle emulsion do not have twin crystal face.

Further, in view of enhancing the uniformity of the localized silver bromide phase among the grains, bromine and/or a bromine ion precursor represented by the following formula (S) may be preferably used. It is also preferable that a compound containing bromide ion is previously contained in an aqueous solution of gelatin, an emulsion containing a coupler, or the like and then mixed with an emulsion.

Formula (S)

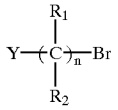

In the above formula (S), Y is an organic group where a Hammett σp value is more than 0. $R_1$ and $R_2$ each independently represents a hydrogen atom, substituted or unsubstituted alkyl group, alkenyl group, aralkyl group, aryl group or a group represented by Y where Y and $R_1$ may form a hetero ring by means of a ring closure. n is an integer of from 1 to 3. When n is 2 or 3, each of a plurality of $R_1$ and each of a plurality of $R_2$ may be same or different.

In the second and fourth embodiments, the silver halide position where the localized silver bromide content is 40 mole % or more may be formed by counter addition of of Ag solution and halide solution. However, the silver halide position where the localized silver bromide content is 40 mole % or more is preferably added in the form of silver halide fine grains. Thus the silver halide position where the localized silver bromide content is 40 mole % or more is formed by dissolving and sedimentation of the silver halide fine grains. The iridium complex may be differently added from the addition of the silver halide grains, however it is more preferable that the iridium complex is previously comprised in the silver halide fine particles.

The interface between the localized silver bromide phase and other phase having different halogen composition may have a clear phase boundary or an ambiguous boundary because of the formation of mixed crystals due to the difference in the compositions. Alternatively, the structure may be one which is caused to change continuously. Silver bromide content and silver iodide content in the silver halide grains may be analyzed by an X-ray diffraction (which is described, for example, in "New Lectures on Experimental Chemistry, 6-Structure Analysis, edited by the Chemical Society of Japan" published by Maruzen), etc.

In the invention, halogen composition of the emulsion may be different or same for the grains but, when an emulsion having the same halogen composition for the grains is used, it is easy to make the property of each particle uniform.

An average grain size of the silver halide grains contained in the silver halide emulsion used in the invention (where diameter of the circle equivalent to the projected area of the particle is regarded as a grain size and its number average is used) is preferably to be 0.1 μm to 2 μm. Further, the grain size distribution is preferably the so-called monodispersed one where the variation coefficient (obtained by dividing the standard deviation of grain size distribution by an average grain size) is preferably 20% or less, more preferably 15% or less and, still more preferably, 10% or less.

It is also preferred to make the grains grain size distribution monodispersed from the view that localized silver bromide and/or silver iodide phase of the silver halide grains of the invention will be uniformly formed among the grains. It is also preferable that the above monodispersed emulsion is used by being blended in the same layer or is subjected to a multi-layer coating in order to achieve a broad latitude.

The silver halide grains used in the invention may be applied to cubes substantially having {100} plane, tetradecahedron grains (where the top of the particle may be round and has higher dimensional planes), crystalline octahedron grains, plate-shaped grains having {100} main plane or {111} main plane or grains of a shape having higher crystal face. However, with regard to the shape of the silver halide grains in the present invention, preferred ones are cubes, tetradecahedrons, plates having {100} main plane or plates having {100} main plane which has {111} plane at a corner.

When the silver halide grains in the invention are the plate-shaped grains, it is preferred that 50% or more of the total projected area is occupied by the projected area of the plate-shaped grains where the aspect ratio is 2 or more and, more preferably, the aspect ratio is 5 or more. The term "aspect ratio" used here is a value obtained by dividing the diameter of a circle having the same area as the area of the main plane of the plate-shaped particle by the distance between the main planes (i.e., thickness of the plate-shaped particle) of the plate-shaped particle.

The silver chloride bromide emulsion or the silver chloride bromide iodide emulsion used in the present invention may be manufactured by the methods described in "Chimie et Physique Photographique" by P. Glafkides (published by Paul Montel, 1967), "Photographic Emulsion Chemistry" by G. F. Duffin (published by Focal Press, 1966), "Making and Coating Photographic Emulsion" by V. L. Zelikman, et al. (published by Focal Press, 1964), etc. Thus, any of acidic method, neutral method and ammonia method may be used and, with regard to a type for the reaction of a soluble silver salt with a soluble halogen salt, any of one-side mixing method, simultaneous mixing method and a combination thereof may be used. It is also possible to use a method where the grains are formed in the atmosphere of an excessive silver ion (the so-called inverted mixing method). As one of the systems of the simultaneous mixing method, it is possible to use a method where pAg in the liquid phase in which silver halide is being produced is kept constant. This is the so-called controlled double jet method. According to this method, a silver halide emulsion where the crystal form is regular and the grains grain size is almost uniform can be prepared. Further, the plate-shaped grains having a {100} main plane can be formed by referring to a method described, for example, in the Japanese Patent Laid-Open No. 7-168296.

Halogen composition in the invention can be freely selected as long as it satisfies the present invention. In the first and third embodiments, it is particularly preferred to have a silver chloride iodide phase or a silver chloride bromide iodide phase containing from 0.01 mole % to 0.5 mole % of silver iodide to the total moles of the silver of the silver halide grains.

When the emulsion of the invention contains silver iodide, introduction of iodide ion may be carried out either by a method where a solution of iodide salt is added solely or a method where an iodide salt solution is added together with addition of a silver salt solution and a higher chloride salt solution. In the latter case, the iodide salt solution and the higher chloride salt solution may be added separately or they may be added as a mixed solution of the iodide salt and the higher chloride salt. The iodide salt is added in a form of a soluble salt such as alkaline or alkaline earth iodide salt. It is also possible to introduce the iodide by cleavage of iodide ion from organic molecules as described in the U.S. Pat. No. 5,389,508. It is further possible to use micrograins of silver iodide as another iodide ion source.

Addition of the iodide salt solution may be carried out only during the particle formation period or may be carried out during another specified period. The position for introducing the iodide ion into the higher chloride emulsion is limited in order to achieve a highly sensitive emulsion with little fogging. Increase in sensitivity is less when introduction of iodide ion is carried out at an inner side of the emulsion particle. Accordingly, it is preferred that addition of the iodide salt solution is carried out at a position which is more toward the outside than 50% of the particle volume, more preferably more toward the outside than 70% thereof and, most preferably, more toward the outside than 80% thereof.

Further, it is preferred that addition of the iodide salt solution is completed at the place which is more inside than 98% of the particle volume or, most preferably, than 96% thereof. When addition of the iodide salt solution is finished at the place which is a little inside from the grain surface, it is possible to give more highly sensitive and lowly fogging emulsion.

Distribution of the iodide ion density in the grains in the direction of depth can be measured by an etching/TOF-SIMS (time of flight-secondary ion mass spectrometry) using, for example, TOF-SIMS of type Trift II manufactured by Phi Evans.

With regard to the TOF-SIMS method, it is specifically described in "Surface Analysis Techniques—Secondary Ion Mass Analysis" edited by the Japanese Surface Science Society, published by Maruzen (1999). When the emulsion grains are analyzed by the etching/TOF-SIMS method, it can be seen that, even when addition of the iodide salt is complete at the inner side of the particle, the iodide ion oozed out to the grain surface.

When the emulsion of the present invention contains silver iodide, it is preferred in the analysis by an etching/TOF-SIMS method that the iodide ion has a maximum density at the grain surface and the iodide ion density decreases toward the inner side.

In the invention, it is possible during the course of formation and/or growth of the silver halide grains to add a transition metal ion and to integrate a metal ion at the inner side and/or on the surface of the silver halide grains. With regard to the metal ion used therefor, a transition metal ion is preferred and iron, ruthenium, iridium, osmium, lead, cadmium or zinc is particularly preferred. It is more preferred that such a metal ion is used as an octahedral complex having six coordinates as well as ligands. When an inorganic compound is used as a ligand, it is preferred to use cyanide ion, halide ion, thiocyan, hydroxide ion, peroxide ion, azide ion, nitrite ion, water, ammonia, nitrosyl ion or thionitrosyl ion and it is also preferred to use these ligands by coordinating them to any of the above-mentioned metal ions of iron, ruthenium, iridium, osmium, lead, cadmium or zinc or to use plural type of ligands in a complex molecule. It is further possible to use an organic compound as a ligand and examples of the preferred organic compounds are an aliphatic compound having 5 or less carbons in the main chain and/or a five-membered or six-membered heterocyclic compound. Examples of more preferred organic compounds are those having nitrogen atoms, phosphorus atoms, oxygen atoms or sulfur atoms in a molecule a coordinating atom to metal and examples of the most preferred organic compounds are furan, thiophene, oxazole, isoxazole, thiazole, isothiazole, imidazole, pyrazole, triazole, furazan, pyran, pyridine, pyridazine, pyrimidine and pyrazine. The compounds as basic skeleton with substituent(s) introduced thereinto are preferred as well.

With regard to a combination of the above-mentioned metal ion with the ligand, a combination of iron ion or ruthenium ion with cyanide ion is preferred. In those compounds, it is preferred that cyanide ion occupies more than one half of the coordination sites which are bonded to the iron or ruthenium center and it is more preferred that the remaining coordination sites are occupied by thiocyan, ammonia, water, nitrosyl ion, dimethyl sulfoxide, pyridine, pyrazine or 4,4'-bipyridine. It is most preferred that all of six coordination sites of the central metal are occupied by cyanide ion forming a hexacyano iron complex or a hexacyano ruthenium complex. In the complex where cyanide ion is a ligand, it is preferred to add from $1\times10^{-8}$ mole to $1\times10^{-2}$ mole per mole of silver during the formation of the grains and it is most preferred to add from $1\times10^{-6}$ mole to $5\times10^{-2}$ mole. When iridium is used as a central metal, preferred ligands are fluoride ion, chloride ion, bromide ion and iodide ion and, among them, the use of chloride ion or bromide ion is more preferred. When ruthenium and osmium are used as central metals, it is preferred that nitrosyl ion, thionitrosyl ion or water molecule is used together with a chloride ion as ligands and it is more preferred to form a pentachloronitrosyl complex, a pentachlorothionitrosyl complex or a pentachlooroaqua complex. It is also preferred to form a hexachloro complex. It is preferred that such a complex is added in an amount of from $1\times10^{-10}$ to $1\times10^{-6}$ mole per mole of silver during the formation of the grains and it is more preferred that from $1\times10^{-9}$ to $1\times10^{-6}$ mole is added.

In the invention, it is preferred that the complex is directly added to the reaction solution during the formation of the silver halide grains or is added to an aqueous solution of a halide for the formation of silver halide grains or to another solution and then added to the reaction solution for the particle formation so as to be integrated into the silver halide grains. It is also preferred that such methods are combined so that the complex is contained in the silver halide grains.

When such a complex is integrated into the silver halide grains, although it is of course preferred to cause it to be uniformly present in the inner part of the particle, it is also preferred that, as disclosed in the Japanese Patent Laid-open Nos. 4-208936, 2-125245 and 3-188437, it is made present only on the surface layer of the particle or is made present only in the inner part of the particle while a layer containing no complex is added to the surface of the particle. It is also preferred that, as disclosed in the U.S. Pat. Nos. 5,252,451 and 5,256,530, quality of the surface phase of the particle is improved by physical aging of fine grains into which the complex is integrated. It is also possible to use those methods by combining them and a plurality of types of complexes may be integrated into one silver halide particle. There is no particular restriction for the halogen composition at the position where the complex is contained but it is preferred that a complex may be contained in any of a silver chloride layer, silver chloride bromide layer, silver bromide layer, silver iodide chloride layer and silver iodide bromide layer.

With an object of prevention of fogging and of stabilization of photographic property during manufacture, preservation or photographic processing of the photosensitive material, it is possible to add various compounds or precursors thereof to the silver halide emulsion of the present invention. With regard to the specific examples of such compounds, those which are described in pages 39–72 of the above-mentioned Japanese Patent Laid-Open No. 62-215272 are preferably used. Further, 5-arylamino-1,2,3,4-thiatriazole compounds (where the said aryl residue has at least one electron-withdrawing group) described in EP 0447647 may be preferably used as well.

Further, in order to enhance the preservability of the silver halide emulsion in the present invention, the following are also preferably used in the invention. They are hydroxamic acid derivatives described in the Japanese Patent Laid-Open No. 11-109576, cyclic ketones having a double bond where at both ends are substituted amino or hydroxyl groups adjacent to a carboxyl group described in the Japanese Patent Laid-Open No. 11-32709 (particularly those represented by the formula (S1) and the paragraphs of from 0036 to 0071 therein may be incorporated into the specification of the present application), sulfo-substituted catechols and hydroquinones described in the Japanese Patent Laid-Open No. 11-143011 (such as 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof), hydroxylamines represented by the formula (A) in the U.S. Pat. No. 5,566,741 (the description in line 56, column 4 to line 22, column 11 of the U.S. Pat. No. 5,566,741 is preferably used in this invention and is incorporated as a part of the specification of the present application) and water-soluble reducing agent represented by the formulae (I)-(III) in the Japanese Patent Laid-Open No. 11-102045.

Spectral sensitization is carried out with an object that spectral sensitivity is given to the desired optical wavelength region for the emulsion in each of the layers in the photosensitive material of the invention.

Examples of the spectral sensitization dye used for spectral sensitization of blue, green and red regions in the photosensitive material of the present invention are those described in "Heterocyclic Compounds—Cyanine Dyes and Related Compounds" by F. M. Harmer (published by John Wiley & Sons [New York, London] in 1964).

With regard to specific examples of the compounds and the molecular sensitization method, those described in the upper right column, page 22 to page 38 of the above-mentioned Japanese Patent Laid-Open No. 62-215272 are preferably used. With regard to the red-sensitive spectral sensitization dyes of silver halide emulsion grains having a particularly high silver chloride content, the spectral sensitization dyes described in the Japanese Patent Laid-Open No. 3-123340 are much preferred in view of stability, intensity of adsorption, temperature-dependency of exposure to light, etc.

Adding amount of such a spectral sensitization dye is within a wide range in some cases and the range of from $0.5\times10^{-6}$ to $1.0\times10^{-2}$ mole per mole of silver halide is preferred and the range of from $1.0\times10^{-6}$ to $5.0\times10^{-3}$ mole is more preferred.

The silver halide emulsion used in the invention is usually subjected to a chemical sensitization. With regard to the chemical sensitization, it is possible to use a sulfur sensitization represented by addition of unstable sulfur compound, a noble metal sensitization represented by gold sensitization and a reduction sensitization either solely or jointly. With regard to the compound used for the chemical sensitization, those described from the lower right column, page 18 to the upper right column of page 22 of the Japanese Patent Laid-Open No. 62-215272 may be preferably used. Among them, those which are subjected to a gold sensitization are particularly preferred. This is because, as a result of being subjected to a gold sensitization, variation in photographic property upon a scanning exposure to light by laser beam, etc. can be made less.

In applying a gold sensitization to the silver halide emulsion used in the invention, it is possible to utilize various inorganic gold compounds, gold (I) complexes having inorganic ligands and gold (I) compounds having organic ligands. With regard to the inorganic gold compound, chloroauric acid or a salt thereof may be used and, with regard to the gold (I) complex having inorganic ligands, a gold dithiocyanate compound such as potassium gold (I) dithiocyanate and a gold dithiosulfate compound such as trisodium gold (I) dithiosulfate may be used.

With regard to the gold (I) compound having an organic ligand, there may be used bis gold (I) mesoion heterocyclic compounds described in the Japanese Patent Laid-Open No. 4-267249 such as gold (I) bis(1,4,5-trimethyl-1,2,4-triazolium-3-thiolate) tetrafluoroborate; organic mercapto gold (I) complexes described in the Japanese Patent Laid-Open No. 11-218870 such as potassium bis(1-[3-(2-sulfonatobenzamido)phenyl]-5-mercaptotetrazole potassium salt) aurate (I) pentahydrate; and gold (I) compounds where nitrogen compound anion is oriented as described in the Japanese Patent Laid-Open No. 4-268550 such as sodium gold (I) bis(1-methylhydantoinate) tetrahydride. It is also possible to use gold (I) thiolate compounds described in the U.S. Pat. No. 3,503,749; gold compounds described in the Japanese Patent Laid-Open Nos. 8-69074, 8-69075 and 9-269554; and the compounds described in the U.S. Pat. Nos. 5,620,841, 5,912,112, 5,620,841, 5,939,245 and 5,912,111.

Although the adding amount of such a compound may vary broadly depending upon the case, it is from $5\times10^{-7}$ to $5\times10^{-3}$ mole or, preferably, from $5\times10^{-6}$ to $5\times10^{-4}$ mole per mole of silver halide.

It is also possible to use a colloidal gold sulfide and a method for manufacturing the same is described in *Research Disclosure,* 37154; *Solid State Ionics*, volume 79, pages 60–66, 1995; *Compt. Rend. Hebt. Seances Acad. Sci. Sect. B*, volume 263, page 1328, 1966; etc.

With regard to a colloidal gold sulfide, those with various sizes may be utilized and those having a grain size of even 50 nm or less may be used as well. Although its adding amount may broadly vary depending upon the case, it is preferably from $5\times10^{-7}$ to $5\times10^{-3}$ mole or, more preferably, from $5\times10^{-6}$ to $5\times10^{-4}$ mole of gold atom per mole of the silver halide.

In the invention, a gold sensitization may be further combined with other sensitization method such as sulfur sensitization, selenium sensitization, tellurium sensitization, reduction sensitization and noble metal sensitization using a compound other than a gold compound.

The silver halide photosensitive material disclosed in the invention uses the silver halide emulsion of the invention mentioned hereinabove. An embodiment of the silver halide photosensitive material of the invention is that which has a photosensitive emulsion layer containing at least one layer of yellow dye-forming coupler-containing silver halide emulsion layer, at least one layer of magenta dye-forming coupler-containing silver halide emulsion layer and at least one layer of cyan dye-forming coupler-containing silver halide emulsion layer on a support and the said at least one layer of the photosensitive emulsion layer contains silver halide grains doped with the iridium compound (A) and silver halide grains doped with the iridium compound (B). Preferably, in the silver halide grains doped with the iridium complex, the iridium compound represented by the formula (I) is doped to the site where the silver chloride content in the silver halide grains is 90 mole % or more and the iridium compound represented by the formula (II) is doped to the site where the silver bromide content in the silver halide grains is 40 mole % or more. Particularly, it corresponds to the photosensitive material of the third/fourth embodiment wherein at least one of the silver halide emulsion of the first/second embodiment is comprised.

In the silver halide photosensitive material of the present invention (hereinafter, may be just referred to as "the photosensitive material"), known photographic materials and additives may be used. These will be described hereinafter.

As to a photographic support for example, a support of a transmission type and a support of a reflection type may be used. With regard to the support of a transmission type, that where an information recording layer such as a magnetic layer is formed on a transparent film such as cellulose nitrate film or polyethylene terephthalate film, polyester of 2,6-naphthalenedicarboxylic acid (NDCA) with ethylene glycol (EG), polyester of NDCA with terephthalic acid and EG, etc. is preferably used. With regard to the support of a reflection type, that which is laminated with a plurality of polyethylene layers or polyester layers and at least one of such waterproof resin layers (laminated layer) contains white pigment such as titanium oxide is particularly preferred.

The more preferred reflective support in the invention is one which has a polyolefin layer having fine pores on a paper substrate on the side where a silver halide emulsion layer is formed. The polyolefin layer may comprise plural layers and, in that case, it is preferred that the polyolefin (such as polypropylene and polypropylene) layer adjacent to a gelatin layer on the side of the silver halide layer has no fine pore and it is more preferred that there is a polyolefin (such as polypropylene and polyethylene) having fine pores at the side near the paper substrate. Density of the plural or single polyolefin layer(s) located between the paper substrate and the layer forming the photograph is preferably 0.40–1.0 g/ml or, more preferably, 0.50–0.70 g/ml. Thickness of the plural or single polyolefin layer(s) located between the paper substrate and the layer forming the photograph is preferably 10–100 $\mu$m or, more preferably, 15–70 $\mu$m. Ratio of thickness of the polyolefin layer to that of the paper substrate is preferably 0.05–0.2 or, more preferably, 0.1–0.15.

It is also preferred that a polyolefin layer is formed on the reverse side (back side) of the layer forming the photograph of the paper substrate in order to increase the rigidity of the reflective support. In that case, the polyolefin layer on the back side is preferably polyethylene or polypropylene where its surface is delustered and such a polypropylene is more preferred. The polyolefin layer on the back side is preferably 5–50 $\mu$m or, more preferably, 10–30 $\mu$m and, in addition, it is preferred that its density is 0.7–1.1 g/ml.

Preferred embodiments for the polyolefin layer formed on the paper substrate in the reflective support of the invention are exemplified in the Japanese Patent Laid-Open Nos. 10-333277, 10-333278, 11-52513 and 11-65024 and EP Nos. 0880065 and 0880066.

It is preferred that a fluorescent whitener is contained in the waterproof resin layer. The fluorescent whitener may be dispersed in a hydrophilic colloid layer in the photosensitive material. With regard to the fluorescent whitener, a benzoxazole type, a coumarin type and a pyrazoline type can be preferably used and a benzoxazolylnaphthalene type or a benzoxazolylstyrene type is more preferred. Although there is no particular limitation for the amount of the fluorescent whitener to be used, 1–100 mg/m$^2$ is preferred. Its mixing ratio when mixed with the waterproof resin is preferably 0.0005–3% by weight or, more preferably, 0.001–0.5% by weight to the resin.

The reflection type support may be one having a hydrophilic colloid layer containing a white pigment coated on a transparent type support or on a reflection type support as above.

The support of a reflection type may also be a support having a metal surface of a mirror plane reflectivity or a diffuse reflectivity of type 2.

With regard to a support used in the silver halide photosensitive material of the present invention, it is also possible to use a white polyester support for display or a support where a layer containing a white pigment is formed on a support at the side having a silver halide emulsion layer. Further, in order to improve the sharpness, it is preferred that an anti-halation layer is coated on a support at the side where the silver halide emulsion layer is coated or at the reverse side thereof. It is particularly preferred that the transmission density of the support is set within a range of 0.35–0.8 so that a display can be seen by both reflected light and transmitted light.

With an object of improving the sharpness, etc. of the image, it is preferred that, in the silver halide photosensitive material of the present invention, a dye which can be decolorized by a processing (particularly, an oxonol dye) described in pages 27–76 of the European Patent EP 0337490 A2 is added to a hydrophilic colloid layer so as to make the optical reflection density of the photosensitive material at 680 nm not less than 0.70 or it is preferred that not less than 0.12% by mass (more preferably, not less than 14% by mass) of titanium oxide which is subjected to a surface processing with a di- to tetrahydric alcohol (such as trimethylolethane), etc. is contained in the waterproof resin layer of the support.

In order to prevent irradiation and halation or to improve the safety of a safety light, it is preferred that, in the silver halide photosensitive material of the present invention, a dye which is capable of being decolorized by a processing (particularly, oxonol dye and cyanine dye) described in pages 27–76 of the European Patent EP 0337490 A2 is added to the hydrophilic colloid layer. Moreover, the dyes described in the European Patent EP 0819977 may be preferably added to the invention as well.

Some of those water-soluble dyes may deteriorate color separation or safety of the safety light when the amount used is increased. With regard to the dye which can be used without deteriorating color separation, water-soluble dyes described in the Japanese Patent Laid-Open Nos. 5-127324, 5-127325 and 5-216185 are preferred.

In the invention, a coloring layer which can be decolorized by a processing is used together with a water-soluble dye or instead of a water-soluble dye. The coloring layer which can be decolorized by the processing used may directly contact the emulsion layer or may be arranged so as to contact the emulsion layer via an intermediate layer containing a color mixing inhibitor such as gelatin and hydroquinone. It is preferred that the coloring layer is formed on a lower layer (at the side of a support) of the emulsion layer coloring in the same type of original color as the colored one. All of each coloring layer corresponding to each original color may be formed or only a part of them may be freely selected and formed. It is also possible to form a coloring layer to which coloration corresponding to a plurality of original color regions. With regard to an optical reflection density of the coloring layer, the optical density value at the wavelength where the optical density is highest is preferably from 0.2 to 3.0, more preferably from 0.5 to 2.5 and, most preferably, from 0.8 to 2.0 in the wavelength region (visible light region of 400 nm to 700 nm in the common exposure by a printer while, in the case of a scanning exposure, the wavelength of the scanning exposure light source used) used for the exposure.

In order to form the colored layer, conventionally known methods may be applied. They are, for example, a method where a dye (such as that described from the upper right column, page 3 to page 8 of the Japanese Patent Laid-Open No. 2-282244 and that described from the upper right column, page 3 to lower left column, page 11 of the Japanese Patent Laid-Open No. 3-7931) in a solid grains dispersion state is included in a hydrophilic colloid layer; a method where an anionic dye is mordanted to a cationic polymer; a method where a dye is adsorbed with fine grains of silver halide, etc. to fix in the layer; and a method where a colloid silver as described in the Japanese Patent Laid-Open No. 1-239544 is used.

An example of a method for dispersing the fine powder of dye in a solid state is described in pages 4–13 of the Japanese Patent Laid-Open No. 2-308244 wherein a dye in fine powder which is substantially insoluble in water at a pH of 6 or more and is substantially soluble in water at a pH 8 or more is included. Further, a method for mordanting an anionic dye to a cationic polymer is described in pages 18–26 of the Japanese Patent Laid-Open No. 2-84637. A method for the preparation of colloid silver as a light absorber is described in the U.S. Pat. Nos. 2,688,601 and 3,459,563. Among those methods, that where a dye in fine powder is included, that where colloid silver is used, etc. are preferred.

It is preferred that the silver halide photosensitive material of the invention is used as color negative film, color positive film, color reversal film, color reversal printing paper, color printing paper, etc. and, among them, use as a color printing paper is preferred.

It is preferred that the color printing paper has at least one layer each of yellow-coloring silver halide emulsion layer, magenta-coloring silver halide emulsion layer and cyan-coloring silver halide emulsion layer and, generally, those silver halide emulsion layers are in the order of yellow-coloring silver halide emulsion layer, magenta-coloring silver halide emulsion layer and cyan-coloring silver halide emulsion layer from the side near the support. However, there is no problem even if the composition of the layers is different from the above.

Although the silver halide emulsion layer containing the yellow coupler may be placed at any position on a support, it is preferred that, when silver halide plate-shaped grains are contained in the yellow coupler-containing layer, that layer is preferably coated at the position which is farther from the support than at least one of the magenta coupler-containing silver halide emulsion layer and the cyan coupler-containing silver halide emulsion layer. In addition, in view of promotion of color development, promotion of removal of silver and decrease in residual color by the sensitizing dye, it is preferred that the yellow coupler-containing silver halide emulsion layer is coated at the furthest position from a support with respect to the other magenta or cyan coupler-containing silver halide emulsion layer. Moreover, in view of a decrease in Blix decoloration, it is preferred that a cyan coupler-containing silver halide emulsion is a middle layer between other silver halide emulsion layers while, in view of a decrease in decoloration by light, it is preferred that a cyan coupler-containing silver halide emulsion layer is in the lowermost layer.

In addition, each of the coloring layers for yellow, magenta and cyan may comprises two or three layers. For example, as described in the Japanese Patent Laid-Open Nos. 4-75055, 9-114035 and 10-246940, the U.S. Pat. No. 5,576,159, etc., it is also preferred that a coupler layer containing no silver halide emulsion is adjacent to the silver halide emulsion layer to form a coloring layer.

With regard to the silver halide emulsion and other materials (such as an additive) and layer forming the photographs (such as a layer arrangement) used in the invention and to the method for the processing and the additive for the processing used for processing the photosensitive material, those which are described in the Japanese Patent Laid-Open Nos. 62-215272 and 2-33144 and the European Patent EP 0355660 A2 (particularly those described in the European Patent EP 0355660 A2) may be preferably used. In addition, the silver halide color photosensitive materials and the processing methods therefor described, for example, in the Japanese Patent Laid-Open Nos. 5-34889, 4-359249, 4-313753,4-270344, 5-66527, 4-34548, 4-145433, 2-854, 1-158431, 2-90154, 3-194539 and 2-93641 and the European Patent Laid-Open No. 0520457 A2 are preferred as well.

In the present invention, the reflection type support and the silver halide emulsion as well as different metal ion type doped in silver halide grains, the preservation stabilizer or anti-fogging agent for silver halide emulsion, the chemical sensitization method (sensitizer), the spectral sensitization method (spectral sensitizer), the cyan-, magenta- and yellow couplers and emulsifying method therefor, color image preservability improving agent (anti-staining agent and fading inhibitor), the dye (coloring layer), the gelatin type, the layer composition of photosensitive material, pH of coat of photosensitive material, etc. are preferably those described in the patents listed in Table 1 which follows:

TABLE 1

| Element | Japanese Patent Laid-Open No. 7-104448 | Japanese Patent Laid-Open No. 7-77775 | Japanese Patent Laid-Open No. 7-301895 |
|---|---|---|---|
| Reflecting type support | line 12, column 7 to line 19, column 12 | line 43, column 35 to line 1, column 44 | Line 40, column 5 to line 26, column 9 |
| Silver Halide Emulsion | line 29, column 72 to line 18, column 74 | line 36, column 44 to line 29, column 46 | Line 48, column 77 to line 28, column 80 |
| Different Metal Ion Type | line 19, column 74 to line 18, same column | line 30, column 46 to line 5, column 47 | Line 29, column 80 to line 6, column 81 |
| Preservation Stabilizer or Anti-fogging agent | line 9, column 75 to line 44, same column | line 20, column 47 to line 29, same column | Line 11, column 18 to line 37, column 31 (particularly, mercapto heterocyclic compounds) |
| Chemical Sensitization Method (Chemical Sensitizer) | line 45, column 74 to line 6, column 75 | line 7, column 47 to line 17, same column | line 9, column 81 to line 17, same column |
| Spectral Sensitization Method (Spectral Sensitizer) | line 19, column 75 to line 45, column 76 | line 30, column 47 to line 6, column 49 | line 21, column 81 to line 48, column 82 |
| Cyan Coupler | line 20, column 12 to line 49, column 39 | line 50, column 62 to line 16, column 63 | line 49, column 88 to line 16, column 89 |
| Yellow Coupler | line 40, column 87 to line 3, column 88 | line 17, column 63 to line 30, same column | line 17, column 89 to line 30, same column |
| Magenta Coupler | line 4, column 88 to line 18, same column | line 3, column 63 to line 11, column 64 | line 34, column 31 to line 44, column 77; line 32, column 88 to line 46, same column |
| Emulsifying/Dispersing Method for Coupler | line 3, column 71 to line 11, column 72 | line 36, column 61 to line 49, same column | line 35, column 87 to line 48, same column |
| Color Image Preservation Improving Agent (Anti-staining agent) | line 50, column 39 to line 9, column 70 | line 50, column 61 to line 49, column 62 | line 49, column 87 to line 48, column 88 |
| Fading Inhibitor | line 10, column 70 to line 2, column 71 | | |
| Dye (Coloring Agent) | line 42, column 77 to line 41, column 78 | line 14, column 7 to line 42, column 19; line 3, column 50 to line 14, column 51 | line 27, column 9 to line 10, column 18 |
| Gelatin Type | line 42, column 78 to line 48, same column | line 15, column 51 to line 20, same column | line 13, column 83 to line 19, same column |
| Layer Composition of Photosensitive Material | line 11, column 39 to line 26, same column | line 2, column 44 to line 35, same column | line 38, column 31 to line 33, column 32 |
| pH of Coat of Photosensitive Material | line 12, column 72 to line 28, same column | | |
| Scanning Exposure | line 6, column 76 to line 41, column 77 | line 7, column 49 to line 2, column 50 | line 49, column 82 to line 12, column 83 |
| Preservative in Developing Solution | line 19, column 88 to line 22, column 89 | | |

With regard to cyan, magenta and yellow couplers used in the invention, the couplers other than the above such as disclosed in from line 4, upper right column, page 91 to line 6, upper left column, page 121 of the Japanese Patent Laid-Open No. 62-215272; from line 14, upper right column, page 3 to last line, upper left column, page 18 and from line 6, upper right column, page 30 to line 11, lower right column, page 36 of the Japanese Patent Laid-Open No. 2-33144; and lines 15 to 27, page 4, from line 30, page 5 to last line, page 28, lines 29–31, page 45 and from line 23, page 47 to line 50, page 63 of EP 0355660 A2 are useful as well.

Moreover, in the present invention, the compounds represented by the formulae (II) and (III) of WO 98/33760 and the compound represented by the formula (D) of the Japanese Patent Laid-Open No. 10-221825 may be added and that is preferred.

As hereunder, the cyan, magenta and yellow couplers will be more specifically described.

With regard to the cyan coupler which can be used in the present invention, that of a pyrolotriazole type is used preferably and the coupler represented by the formula (I) or (II) in the Japanese Patent Laid-Open No. 5-313324 and that represented by the formula (I) in the Japanese Patent Laid-Open No. 6-347960 and exemplified couplers described in those patents are particularly preferred.

In addition, cyan couplers of a phenol type and a naphthol type are preferred as well and, for example, a cyan coupler represented by the formula (ADF) described in the Japanese Patent Laid-Open No. 10-333297 is preferred.

With regard to cyan couplers other than the above-mentioned ones, cyan couplers of a pyroroazole type described in the European Patents EP 0488248 and EP 0491197 Al; 2,5-diacylaminophenol couplers described in the U.S. Pat. No. 5,888,716; cyan couplers of a pyrazoloazole type having hydrogen bonding group and electron-attractive group at 6-position described in the U.S. Pat. No. 4,873,183 and 4,916,051; and, particularly, cyan couplers of a pyrazoloazole type having a carbamoyl group at 6-position described in the Japanese Patent Laid-Open Nos. 8-171185, 8-311360 and 8-339060 are also preferred.

Besides cyan couplers of a diphenylimidazole type described in the Japanese Patent Laid-Open No. 2-33144, it is also possible to use cyan couplers of a 3-hydroxypyridine type (a four-equivalent coupler of a coupler (42) which is made into a two-eqivalent type by adding a chlorine-leaving group and couplers (6) and (9) which are listed as specific examples are particularly preferred) described in the European Patent EP 0333185 A2; cyan couplers of a cyclic active methylene type (the couplers 3, 8 and 34 listed as specific examples are particularly preferred) described in the Japanese Patent Laid-Open No. 1-32260; cyan couplers of a pyrrolopyrazole type described in the European Patent EP 0456226 A1; and cyan couplers of a pyrroloimidazle type described in the European Patent EP 0484909.

Among those cyan couplers, the particularly preferred ones are cyan couplers of a pyrroloazole type represented by the formula (I) described in the Japanese Patent Laid-Open No. 11-282138 and the descriptions in the paragraph numbers of from 0012 to 0059 of the said patent including the exemplified cyan couplers (1)–(47) are applied to the invention as they are and are preferably incorporated as a part of the specification of the present application.

With regard to the magenta couplers which are able to be used in the invention, magenta couplers of a 5-pyrazolone type and magenta couplers of a pyrazoloazole type described in the known literatures mentioned in Table 1 are used and, among them, the use of the followings is particularly preferred in view of hue, image stability, coloration, etc. They are pyrazolotriazole couplers where a secondary or tertiary alkyl group is directly bonded to 2-, 3-or 6-position of a pyrazolotriazole ring as described in the Japanese Patent Laid-Open No. 61-65245; pyrazoloazole couplers containing a sulfonamide group in a molecule as described in the Japanese Patent Laid-Open NO. 61-65246; pyrazoloazole couplers having an alkoxyphenyl sulfonamide ballast group as described in the Japanese Patent Laid-Open No. 61-147254; and pyrzoloazole couplers having an alkoxy group or an aryloxy group at 6-position as described in the European Patents No. 226849 A and 294785 A.

With regard to magenta couplers, pyrazoloazole couplers represented by the formula (M-I) described in the Japanese Patent Laid-Open No. 8-122984 are particularly preferred and the paragraph numbers from 0009 to 0026 of the said patent can be used in the present application as they are and incorporated as a part of the specification of the present application.

In addition, pyrazoloazole couplers having steric hindrance groups at both 3-and 6-positions as described in the European Patent Nos. 854384 and 884640 are preferably used as well.

With regard to yellow couplers which can be used in the invention, the following are preferably used besides the compounds mentioned in Table 1. They are yellow couplers of an acylacetamide type having a three to five-membered ring structure at an acyl group described in the European Patent EP 0447969 A1; yellow coupler of a malon dianilide type having a cyclic structure described in the European Patent EP 0482552 A1; couplers of a pyrrol-2- or 3-y1 or indol-2- or 3-y1 carbonyl acetanilide type described in the European Patents 953870 A1, 953871 A1, 953872 A1, 953873 A1, 953874 A1 and 953875 A1; and yellow couplers of an acylacetamide type having a dioxane structure described in the U.S. Pat. No. 5,118,599. Among them, the use of yellow couplers of an acylacetamide type where an acyl group is a 1-alkylcyclopropane-1-carbonyl group and yellow couplers of a malon dianilide type where one of the anilides constitutes an indoline ring is particularly preferred. Each of those couplers may be used either solely or jointly.

It is preferred that the coupler used in the invention is impregnated with a low double latex polymer (that which is described, for example, in the U.S. Pat. No. 4,203,716) in the presence (or absence) of a high-boiling organic solvent described in Table 1 or is dissolved together with a polymer which is insoluble in water and is soluble in an organic solvent to emulsify/disperse in an aqueous solution of hydrophilic colloid.

Examples of the preferably used polymer which is insoluble in water and soluble in an organic solvent are homopolymers and copolymers described in columns 7 to 15 of the U.S. Pat. No. 4,857,449 and pages 12 to 30 of the International Laid-Open WO 88/00723. To be more specific, polymers of a methacrylate type or an acrylamide type are more preferred and, in view of a color image stability, the use of polymers of an acrylamide type is particularly preferred.

In the invention, known color mixing inhibitors may be used and, among them, those described in the following patents are preferred.

For example, there may be used redox compounds having high molecular weight described in the Japanese Patent Laid-Open No. 5-333501; compounds of a phenidone type and a hydrazine type described in WO 98/33760, the U.S. Pat. No. 4,923,787, etc.; and white couplers described in the Japanese Patent Laid-Open Nos. 5-249637 and 10-282615 and the German Patent No. 19629142 Al. Especially when pH of the developing solution is increased to conduct the development quickly, it is also preferred to use the redox compounds described in the German Patent No. 19618786 A1, the European Patent Nos. 839623 A1 and 842975 A1, the German Patent No. 19806846 A1 and the French Patent No. 2760460 A1.

In the present invention, it is preferred to use a compound having a triazine skeleton showing a high molar absorption coefficient as an ultraviolet absorber and, for example, the compounds described in the following patents may be used. They are preferably added to a photosensitive layer and/or a non-photosensitive layer.

Thus, they are compounds described in the Japanese Patent Laid-Open Nos. 46-3335, 55-152776, 5-197074, 5-232630, 5-307232, 6-211813, 6-53427, 8-234364, 8-239368, 9-31067, 10-115898, 10-147577 and 10-182621; the German Patent No. 19739797; the European Patent No. 711804 A and the Japanese Patent Laid-Open No. 8-501291.

With regard to a binder or a protective colloid which can be used in the silver halide photosensitive material of the invention, it is advantageous to use gelatin but it is also possible to use other hydrophilic colloid either solely or together with gelatin. With regard to gelatin, it is preferred to use that containing not more than 5 ppm or, more preferably, not more than 3 ppm of heavy metals such as iron, copper, zinc and manganese as impurities.

With regard to the amount of calcium contained in the silver halide photosensitive material, it is preferred to be not more than 20 $mg/m^2$, more preferably, not more than 10 $mg/m^2$ and, most preferably, not more than 5 $mg/m^2$.

In the present invention, it is preferred in view of protection from various kinds of fungi and bacteria which may grow in the hydrophilic colloid layer and deteriorate the image, to add antibacterial/antifungal agent as described in the Japanese Patent Laid-Open No. 63-271247.

With regard to the pH of the coat of the silver halide photosensitive material, it is preferably 4.0–7.0 and, more preferably, 4.0–6.5.

In the present invention, a surface-active agent may be added to the silver halide photosensitive material in view of improvement in a coating stability of the silver halide photosensitive material, prevention of generation of static electricity, adjustment of electric charge amount, etc. The surface-active agent may be an anionic surface-active agent, a cationic surface-active agent, a betaine type surface-active agent or a nonionic surface-active agent and, for example, those described in the Japanese Patent Laid-Open No. 5-333492 are available. With regard to the surface-active agent used in the present invention, one containing fluorine atom is preferred and surface-active agent containing fluorine atom is particularly preferably used.

Although there is no particular limitation for the adding amount of the surface-active agent to the silver halide photosensitive material, it is usually from $1\times10^{-5}$ to 1 g/m$^2$, preferably from $1\times10^{-4}$ to $1\times10^{-1}$ g/m$^2$ and, more preferably, from $1\times10^{-3}$ to $1\times10^{-2}$ g/m$^2$.

Although the above-mentioned fluorine-containing surface-active agent maybe used either solely or together with other conventionally known surface-active agent, it is preferably used together with other conventionally known surface-active agent.

In addition to use in a printing system using usual negative printers, the silver halide photosensitive material of the present invention is also suitable for use in a scanning exposure system using a cathode-ray tube (CRT). The cathode-ray tube exposure system is simple and compact as compared with the apparatus using laser resulting in a low cost. Adjustment of optical axis and color adjustment is easy as well.

In the cathode-ray tube used for an image exposure, various kinds of luminous bodies showing luminance in a spectral region are used if necessary. For example, any one of or a mixture of any two or more of red luminous body, green luminous body and blue luminous body may be used. The spectral region is not limited to the above-mentioned red, green and blue but a fluorescent body emitting the light of a yellow color, orange color, violet color or in an infrared region may be used as well. In particular, a cathode-ray tube emitting a white color by mixing those luminous bodies is frequently used.

When the silver halide photosensitive material has a plurality of photosensitive layers having different spectral sensitivity distributions and the cathode-ray tube also has a luminous body showing luminance of a plurality of spectral regions, it is also possible that a plurality of colors is exposed each time or, in other words, image signals of a plurality of colors are inputted into a cathode-ray tube and emitted from the surface of the tube. It is further possible to adopt a method (plane-sequential exposure) where an image signal for each color is sequentially inputted so that luminance for each color is sequentially carried out and an exposure is carried out by passing the image signal through a film which cuts out colors other than the particular color. Since the plane-sequential exposure can usually use a cathode-ray tube with a high resolving power, that is preferred in view of making the quality of the image high.

For the silver halide photosensitive material of the invention, there are preferably used digital scanning exposure system using monochromatic high-density light such as gas laser, light emitting diode, semiconductor laser or second harmonic generating source (SHG) where solid laser using semiconductor laser as a light exciting source is combined with non-linear optical crystals. In order to make the system compact and less expensive, it is preferred to use semiconductor laser or second harmonic generating source (SHG) where semiconductor laser or solid laser is combined with non-linear optical crystals. In order to achieve an apparatus which is compact, less expensive and has long life and high stability, it is preferred to use semiconductor laser and it is preferred that at least one of exposure light sources uses semiconductor laser.

When such a scanning exposure light source is used, the maximum wavelength for the spectral sensitivity of the silver halide photosensitive material of the present invention can be freely set depending upon the wavelength of the light source which is being used for the scanning exposure. In the case of solid laser using a semiconductor laser as a light exciting source or in the case of SHG light source obtained by a combination of semiconductor laser and non-linear optical crystal, oscillation wavelength of the laser can be made one half whereby blue light and green light are achieved. Accordingly, it is possible that the photosensitive material can have a spectral sensitivity maximum in the usual three wavelength regions of blue, green and red.

When the exposure time in such a scanning exposure is defined as a time for exposing a pixel size when a pixel density is made 400 dpi, the preferred exposure time is not longer than $10^{-4}$ second or, more preferably, not longer than $10^{-6}$ second.

Preferred scanning exposure systems which are applicable in the present invention are described in detail in the patents shown in Table 1.

In processing the silver halide photosensitive material of the invention, the processing materials and the processing methods described in from line 1, lower right column, page 26 to line 9, upper right column, page 34 of the Japanese Patent Laid-Open No. 2-207250 and from line 27, upper left column, page 5 to line 20, lower right column, page 18 of the Japanese Patent Laid-Open No. 4-97355 are preferably applied. With regard to the preservative used for this developing solution, the compounds described in the patents shown in Table 1 are preferably used.

The silver halide photosensitive material of the present invention can be also preferably applied as a photosensitive material suitable for a quick processing.

Time for color development is the time from when the photosensitive material is put into a color developing solution until when it is put into a bleaching/fixing solution in the next processing step. For example, when a processing is carried out using an automatic developing machine, time for color development means a sum of the time (the so-called in-the-liquid time) when the photosensitive material is dipped in the color developing solution and the time (the so-called in-the-air time) when the photosensitive material is taken out from the color developing solution and is conveyed in air to the bleaching/fixing bath in the next processing step. Similarly, the bleaching/fixing time is a time from the photosensitive material is put into a bleaching/fixing solution until it is brought to the next water washing or stabilizing bath. Further, washing time or stabilizing time is a time (the so-called in-the-liquid time) from the photosensitive material is put into the water for washing or into stabilizing bath until it is brought to a drying step.

When a quick processing is carried out in the invention, time for color development is preferably not longer than 60 seconds, more preferably from 50 seconds to 6 seconds and, most preferably, from 30 seconds to 6 seconds. Similarly, time for bleaching/fixing is preferably not longer than 60 seconds, more preferably from 50 seconds to 6 seconds and, most preferably, from 30 seconds to 6 seconds. With regard to time for washing with water or for stabilization, it is preferably not longer than 150 seconds and, more preferably, from 130 seconds to 6 seconds.

With regard to a method where the silver halide photosensitive material of the present invention is exposed to light and then developed, it is possible to use a wet method such as a conventional method where development is carried out using a developing solution containing alkaline agent and developer and a method (hereinafter, referred to as "activator method") where developer is contained in the photosensitive material and development is carried out using an activator solution such as an alkaline solution containing no developer. It is also possible to use a thermal development using no processing solution. Particularly, since no developer is contained in the processing solution in the activator method, administration and handling of the processing solution are easy and there is little waste and therefore, this method is preferred in view of preservation of the environment.

With regard to the developer or a precursor thereof contained in the photosensitive material, compounds of a hydrazine type described, for example, in the Japanese Patent Laid-Open Nos. 8-234388, 9-152686, 9-152693, 9-211814 and 9-160193 are preferred.

In addition, a developing method where the coated silver amount for the photosensitive material is reduced and an image amplifying processing (intensifying processing) using hydrogen peroxide is used is preferably used as well. It is particularly preferred that this method is used for the activator method. To be more specific, an image formation method using an activator solution containing hydrogen peroxide described in the Japanese Patent Laid-Open No. 8-297354 and 9-152695 is used preferably.

In the activator method, removal of silver is usually carried out after processing with an activator solution while, in an image amplifying processing method using a photosensitive material containing low amount of silver, it is possible to carry out a simple method of washing with water or subjecting the photosensitive material to stabilization where removal of silver is omitted. In a system where image information is read out by a scanner or the like from the photosensitive material, it is possible to adopt a processing mode where removal of silver is unnecessary even when a photosensitive material containing high amount of silver such as a photosensitive material for taking pictures is used.

With regard to processing materials and processing methods such as an activator solution used in the activator method, a silver-removing solution (bleaching/fixing solution), washing with water and stabilizing solution, known ones may be used. Preferably, those which are described in Research Disclosure, Item 36544 (September, 1994) pages 536–541 and the Japanese Patent Laid-Open No. 8-234388 may be used.

It is preferred to use a band stop filter described in the U.S. Pat. No. 4,880,726 in subjecting the silver halide photosensitive material to a printer exposure. As a result, optical color mixing is avoided and color reproducibility is significantly improved.

In the invention, a copying restriction may be applied by a pre-exposure of yellow micro-dot pattern before giving an image information as described in the European Patent Nos. EP 0789270 A1 and EP 0789480 A1.

The silver halide photosensitive material of the present invention can be preferably used by combining the exposure and development systems described in the following known references. They are:

- an automatic printing and developing system described in the Japanese Patent Laid-Open No. 10-333253;
- a carrying apparatus for photosensitive material described in the Japanese Patent Laid-Open No. 12-10206;
- a recording system including an image reading-out system described in the Japanese Patent Laid-Open No. 11-215312;
- an exposure system comprising a color image recording system described in the Japanese Patent Laid-Open Nos. 11-88619 and 10-202950;
- a digital photo-printing system including a telediagnosis system described in the Japanese Patent Laid-Open No. 10-210206; and
- a photo-printing system including an image recording apparatus described in the Japanese Patent Laid-Open No. 10-159187.

EXAMPLES

The invention will now be specifically described by way of the following Examples although the invention is not limited to those Examples.

Example 1

Emulsions used for the preparation of the silver halide photosensitive material of the present invention and emulsions for comparison were prepared as follows.

Preparation of Emulsion A-1.

A 3% aqueous solution of lime-treated gelatin (1000 ml) was adjusted to pH 3.3 and pC 11.7 and an aqueous solution containing 2.12 moles of silver nitrate and an aqueous solution containing 2.2 moles of sodium chloride were added thereto and mixed therewith at the same time and stirred vigorously. A desalting processing was carried out at 40° C. and 168 g of lime-treated gelatin were added and then the pH was adjusted to 5.7 and the pC to 11.8. An emulsion where the above emulsion was subjected to the following chemical sensitization was prepared and the resulting emulsion was called emulsion A-1.

The emulsion A-1 comprised cubic grains having a side length of 0.38 $\mu$m and variation coefficient of 9% and contained 0.3 mole % of silver bromide per mole of silver halide. In the emulsion A-1, the silver amount of the site occupied by the localized silver bromide phase, which has a local silver bromide content of 5 mole % or more, was less than 1 mole % of the total silver amount of the silver halide grains.

Chemical Sensitization Step.

$5\times10^{-6}$ mole each of sodium thiosulfonate and sodium thiosulfinate was added per mole of silver halide and then $4\times10^{-5}$ mole of the sensitizing dye D described later and $1\times10^{-5}$ mole each of the sensitizing dyes E and F also described later were added per mole of silver halide. After that, the previously-prepared emulsion of fine grains of silver chloride bromide (comprising fine grains of silver halide having an average grain size of 0.03 $\mu$m and a silver bromide content of 60 mole %) was added in an amount of $3.0\times10^{-3}$ mole per mole of silver halide and heated at 60° C. to form a localized silver bromide phase on the surface of the grains.

After a gold sulfur sensitization is carried out in an optimal manner by adding potassium chloroaurate and triethylthiourea, $5\times10^{-4}$ mole each of 1-phenyl-5-mercaptotetrazole and 1-(5-methylureidophenyl)-5-mercaptotetrazole was added per mole of silver halide.

Preparation of Emulsion A-2.

An emulsion A-2 which was different from the emulsion A-1 only in such a respect that, during the period when the addition of silver nitrate was 98%–100% complete, an aqueous solution of $K_2[IrCl_6]$ was added so that the amount of Ir per mole of the resulting silver halide was made $2\times10^{-7}$ mole.

Preparation of Emulsion A-3.

There was prepared an emulsion A-3 which was different from the emulsion A-1 only in such a respect that, during the period when addition of silver nitrate was 92%–97% complete, an aqueous solution of $K_2[Ir(H_2O)Cl_5]$ was added so that the amount of Ir per mole of the resulting silver halide was made $2\times10^{-7}$ mole.

Preparation of Emulsion A-4.

There was prepared an emulsion A-4 which was different from the emulsion A-1 only in such a respect that, during the period when addition of silver nitrate was 92%–97% complete, an aqueous solution of $K_2[Ir(thiazole)Cl_5]$ was added so that the amount of Ir per mole of the resulting silver halide was made $2\times10^{-7}$ mole.

Preparation of Emulsion A-5.

There was prepared an emulsion A-5 which was even more different from the emulsion A-3 in such a respect that, during the period when addition of silver nitrate was 98%–100% complete, an aqueous solution of $K_2[IrCl_6]$ was added so that the amount of Ir per mole of the resulting silver halide was made $2\times10^{-5}$ mole.

Preparation of Emulsion A-6.

There was prepared an emulsion A-6 which was different from the emulsion A-4 further in such a respect that, during the period when addition of silver nitrate was 98%–100% complete, an aqueous solution of $K_2[IrCl_6]$ was added so that the amount of Ir per mole of the resulting silver halide was made $2\times10^{-7}$ mole.

Grain size, grain size distribution and halogen composition of the emulsions A-2 to A-6 were as same as those of the emulsion A-1.

Preparation of Emulsion B-1.

There was prepared an emulsion B-1 which was different from the emulsion A-1 only in such a respect that, during the period when addition of silver nitrate was 85%–100% complete, one part of sodium chloride in an aqueous solution of sodium chloride was substituted with the same amount of moles of potassium bromide. In this case, 0.0636 mole of sodium chloride was substituted with potassium bromide. The emulsion B-1 comprises cubic grains having a side length of 0.38 $\mu$m and a variation coefficient of 9%. It contains 3.3 mole % of silver bromide per mole of silver halide and has a localized silver bromide phase constituted from about 20 mole % of a local silver bromide content and about 15 mole % of a silver amount of the total silver amount of the silver halide grains.

Preparation of Emulsion B-2.

There was prepared an emulsion B-2 which was different from the emulsion B-1 only in such a respect that, during the period when addition of silver nitrate was 98%–100%, an aqueous solution of $K_2[IrCl_6]$ was added so that the amount of Ir per mole of silver halide was made $2\times10^{-7}$ mole.

Preparation of Emulsion B-2-2.

There was prepared an emulsion B-2-2 which was different from the emulsion B-2 only in such a respect that, during the period when addition of silver nitrate was 98%–100% complete, the amount of an aqueous solution of $K_2$ $[IrCl_6]$ added was changed so that the amount of Ir per mole of the resulting silver halide was made $1\times10^{-7}$ mole.

Preparation of Emulsion B-3.

There was prepared an emulsion B-3 which was different from the emulsion B-1 only in such a respect that, during the period when addition of silver nitrate was 92%–97% complete, an aqueous solution of $K_2[Ir(H_2O)Cl_5]$ was added so that the amount of Ir per mole of the resulting silver halide was made $2\times10^{-7}$ mole.

Preparation of Emulsion B-3-2.

There was prepared an emulsion B-3-2 which was different from the emulsion B-3 only in such a respect that, during the period when addition of silver nitrate was 92%–97% complete, the amount of an aqueous solution of $K_2[Ir(H_2O)Cl_5]$ added was changed so that the amount of Ir per mole of the resulting silver halide was made $4\times10^{-7}$ mole.

Preparation of Emulsion B-4.

There was prepared an emulsion B-4 which was different from the emulsion B-1 only in such a respect that, during the period when addition of silver nitrate was 92%–97% complete, an aqueous solution of $K_2[Ir(thiazole)Cl_5]$ was added so that the amount of Ir per mole of the resulting silver halide was made $2\times10^{-7}$ mole.

Preparation of Emulsion B-5.

There was prepared an emulsion B-5 which was even more different from the emulsion B-3 in such a respect that, during the period when addition of silver nitrate was 98%–100% complete, an aqueous solution of $K_2[IrCl_6]$ was added so that the amount of Ir per mole of the resulting silver halide was made $1\times10^{-7}$ mole.

Preparation of Emulsion B-5-2.

There was prepared an emulsion B-5-2 which was different from the emulsion B-5 only in such a respect that the timing of the adding of an aqueous solution of $K_2[IrCl_6]$ was changed. Here, addition of an aqueous solution of $K_2[IrCl_6]$ was carried out when addition of silver nitrate was 80%–82% complete.

Preparation of Emulsion B-6.

There was prepared an emulsion B-6 which was even more different from the emulsion B-4 in such a respect that, during the period when addition of silver nitrate was 98%–100%, an aqueous solution of $K_2[IrCl_6]$ was added so that the amount of Ir per mole of the resulting silver halide was made $1\times10^{-7}$ mole.

Preparation of Emulsion B-7.

There was prepared an emulsion B-7 which was different from the emulsion B-4 only in such a respect that the iridium compound added during the period where addition of silver nitrate was 92%–97% complete was changed from $K_2[Ir(H_2O)Cl_5]$ to $K_2[Ir(O)Cl_5]$ Grain size, grain size distribution and halogen composition of the emulsions B-2 to B-7, B-2-2, B-3-2 and B-5-2 were same as those of the emulsion B-1.

Preparation of Emulsion B-8.

There was prepared an emulsion B-8 which was different from the emulsion B-5 only in such a respect that the timing of substituting a part of sodium chloride with potassium bromide and also the timing of adding an aqueous solution of $K_2[IrCl_6]$ were changed.

Here, the timing of substituting a part of sodium chloride with potassium bromide was made at the period when addition of silver nitrate was 80%–90% complete whereupon a part of sodium chloride in an aqueous solution of sodium chloride which was added at the same time was substituted with the same number of moles of potassium bromide. Here, 0.0636 mole of sodium chloride was substituted with potassium bromide. Addition of an aqueous solution emulsion of $[IrCl_6]$ was carried out at the period when addition of silver nitrate was 82%–88% complete.

The emulsion B-8 comprises cubic grains having a side length of 0.38 $\mu$m and a variation coefficient of 9%. It also contains 3.3 mole % of silver bromide per mole of silver halide and has a localized silver bromide phase constituted from about 30 mole % of a local silver bromide content and about 10 mole % of silver amount the total silver amount of the silver halide grains.

Preparation of Emulsion B-9.

There was prepared an emulsion B-9 which was different from the emulsion B-5 only in such a respect that the timing of substituting a part of sodium chloride with potassium bromide was changed.

Here, the timing of substituting a part of sodium chloride with potassium bromide was made at the period when addition of silver nitrate was 94%–100% complete whereupon a part of sodium chloride in an aqueous solution of sodium chloride which was added at the same time was substituted with the same amount of moles of potassium bromide. Here, 0.0636 mole of sodium chloride was substituted with potassium bromide.

The emulsion B-9 comprises cubic grains having a side length of 0.38 $\mu$m and a variation coefficient of 9%. It also contains 3.3 mole % of silver bromide per mole of silver halide and has a localized silver bromide phase constituted from about 50 mole % of a local silver bromide content and a silver amount of about 6 mole % of the total silver amount of the silver halide grains.

Preparation of Emulsion B-5-3.

There was prepared an emulsion B-5-3 which was different from the emulsion B-5 only in such a respect that the timing of substituting a part of sodium chloride with potassium bromide was changed.

Here, the timing of substituting a part of sodium chloride with potassium bromide was made at the period when addition of silver nitrate was 25%–100% complete whereupon a part of sodium chloride in an aqueous solution of sodium chloride which was added at the same time was substituted with the same amount of moles of potassium bromide. Here, 0.0636 mole of sodium chloride was substituted with potassium bromide.

The emulsion B-5-3 comprises cubic grains having a side length of 0.38 $\mu$m and a variation coefficient of 9%. It also contains 3.3 mole % of silver bromide per mole of silver halide and has a localized silver chloride bromide phase constituted from about 4 mole % of a local silver bromide content and a silver amount of about 75 mole % of the total silver amount of the silver halide grains.

Preparation of Emulsion B-5-4.

There was prepared an emulsion B-5-4 which was different from the emulsion B-5 only in such a respect that the amount of an aqueous solution of $K_2[IrCl_6]$ and the amount of an aqueous solution of $K_2[Ir(H_2O)Cl_5]$ were changed.

Here the adding amounts of the aqueous solution of $K_2[IrCl_6]$ and the aqueous solution of $K_2[Ir(H_2O)Cl_5]$ were made in such a respect that the amounts of the iridium added to a mole of silver halide were made $5\times10^{-8}$ mole and $2.5\times10^{-7}$ mole, respectively.

Preparation of Sample of Silver Halide Color Photosensitive Material.

A corona discharge processing was carried out on the surface of a support where both sides of paper were coated with a polyethylene resin, then a gelatin undercoat layer containing sodium dodecylbenzenesulfonate was coated and the first to seventh photographic constituting layers were successively coated to prepare a sample of a silver halide color photographic material having the following layer composition. Coating solution for each photographic composition layer was prepared as follows.

Preparation of Coating Solution for First Layer.

Into 21 g of a solvent (Solv-1) and 80 ml of ethyl acetate were dissolved 57 g of yellow coupler (ExY), 7 g of color image stabilizer (Cpd-1), 4 g of color image stabilizer (Cpd-2), 7 g of color image stabilizer (Cpd-3) and 2 g of color image stabilizer (Cpd-8) and the resulting solution was emulsified/dispersed in 220 g of a 23.5% by mass solution of gelatin containing 4 g of sodium dodecylbenzenesulfonate using a high-speed stirrer/emulsifier (Dissolver) followed by adding water thereto whereupon an emulsified dispersion A was prepared.

The emulsified dispersion A and a blue-sensitive emulsion Em-1 (a 1:1 [in terms of molar ratio of silver] mixture of a large particle emulsion of cubes sensitized with gold and sulfur and having an average grain size of 0.68 $\mu$m and a small particle emulsion of the same having an average grain size of 0.59 $\mu$m; coefficients of variances of the grain size distribution thereof were 0.08 and 0.09, respectively; each of the emulsions contained 0.15 mole % of silver iodide near the surface of the grains and 0.45 mole % of silver bromide was made locally contained on the surface of the grains) were mixed and dissolved to prepare the first layer coating solution so as to give the composition shown below. Coating amount of the emulsion was given on the basis of the amount of silver.

Coating solutions for the second layer to the seventh layer were also prepared by the same method as for the coating solution for the first layer. With regard to hardeners for gelatin for each layer, 1-oxy-3,5-dichloro-s-triazine sodium salts (H-1), (H-2) and (H-3) were used in an amount of 100 mg/m$^2$ as a whole. Further, to each of the entire layers were added Ab-1, Ab-2, Ab-3 and Ab-4 in an amount of 15.0 mg/m$^2$, 60.0 mg/m$^2$, 5.0 mg/m$^2$ and 10.0 mg/m$^2$, respectively. (H-1) Hardener (1.4% by mass to gelatin were used)

(H-1) Hardener (1.4% by mass to gelatin were used)

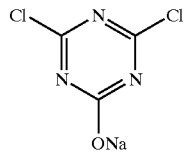

(H-2) Hardener

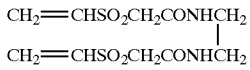

(H-3) Hardener

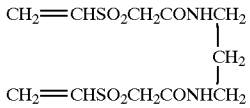

(Ab-1) Antiseptic

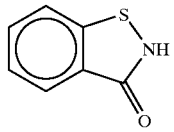

(Ab-2) Antiseptic

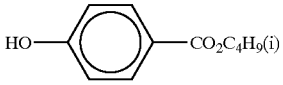

-continued (Ab-3) Antiseptic

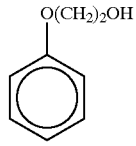

(Ab-4) Antiseptic

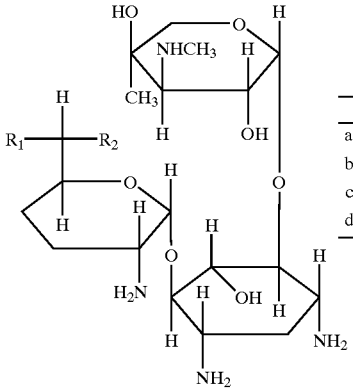

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

a 1:1:1:1 mixture (in molar ratio) of a, b, c and d

In the silver chloride bromide emulsion for each of the blue-, green- and red-sensitive emulsion layers, each of the following spectral sensitizing dyes was used.

Blue-Sensitive Emulsion Layer (Sensitizing Dye A)

(Sensitizing Dye A)

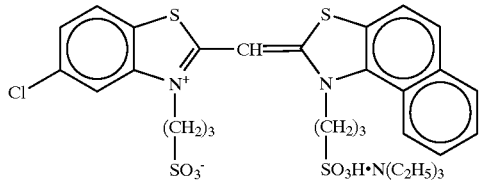

(Sensitizing Dye B)

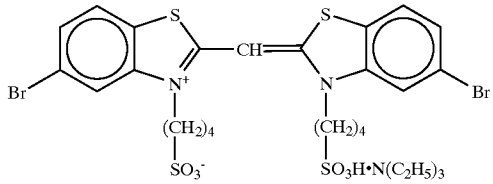

(Sensitizing Dye C)

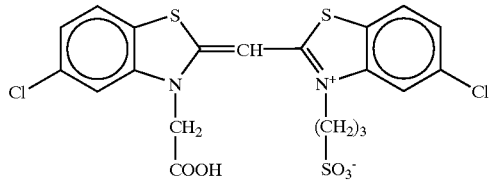

Per mole of silver halide, each of the sensitizing dyes A and B was added in an amount of $1.5\times10^{-4}$ mole to the large particle emulsion and in an amount of $1.7\times10^{-4}$ mole to the small particle emulsion. Further, for each mole of silver halide, the sensitizing dye C was added in an amount of $5.0\times10^{-5}$ mole to the large particle emulsion and in an amount of $5.8\times10^{-5}$ mole to the small particle emulsion.

Green-sensitive Emulsion Layer (Sensitizing Dye D)

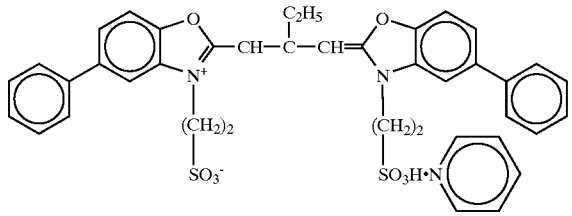

(Sensitizing Dye E)

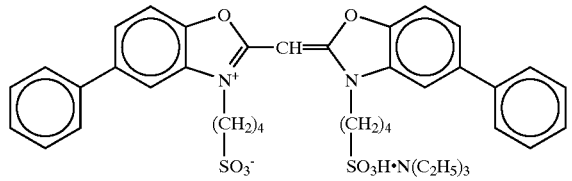

(Sensitizing Dye F)

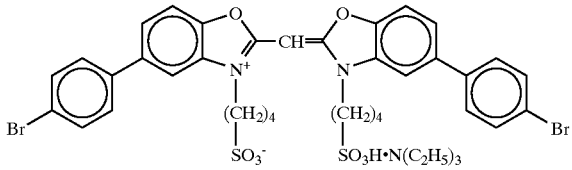

(For each mole of silver halide, the sensitizing dye D was added in an amount of $3.0\times10^{-4}$ mole to the large particle emulsion and in an amount of $3.6\times10^{-4}$ mole to the small particle emulsion; for each mole of silver halide, the sensitizing dye E was added in an amount of $4.0\times10^{-5}$ mole to the large particle emulsion and in an amount of $7.0\times10^{-5}$ mole to the small particle emulsion; and, for each mole of silver halide, the sensitizing dye F was added in an amount of $2.0\times10^{-4}$ mole to the large particle emulsion and in an amount of $2.8\times10^{-4}$ mole to the small particle emulsion.)

(Sensitizing Dye G)

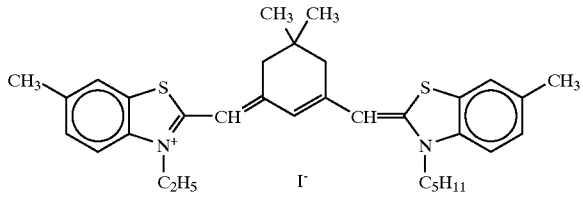

(Sensitizing Dye H)

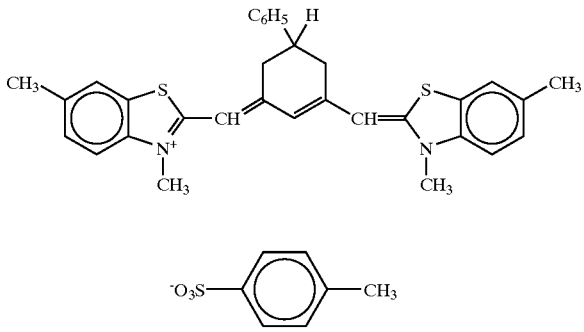

For each mole of silver halide, each of the sensitizing dyes G and H was added in an amount of $8.0\times10^{-5}$ mole to the large particle emulsion and in an amount of $10.7\times10^{-5}$ mole to the small particle emulsion.

Further, the following compound I was added to a red-sensitive emulsion layer in an amount of $3.0\times10^{-3}$ mole per mole of silver halide.

(Compound I)

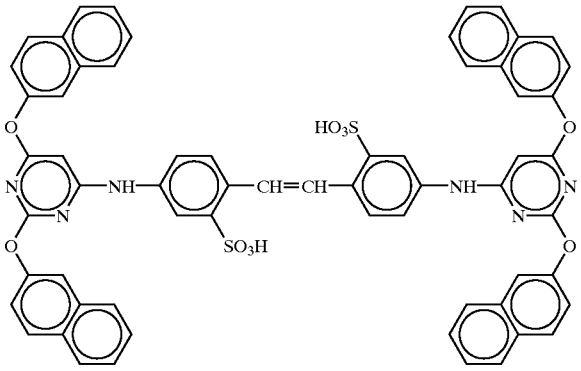

Further, to the blue-sensitive emulsion layer and the red-sensitive emulsion layer, $2.0\times10^{-4}$ mole and $5.0\times10^{-4}$ mole, respectively, of 1-phenyl-5-mercaptotetrazole were added per mole of silver halide.

Furthermore, to the blue-sensitive emulsion layer and the red-sensitive emulsion layer, each $2.0\times10^{-4}$ mole and $5.0\times10^{-4}$ mole, respectively, of 1-phenyl-5-mercaptotetrazole and 1-(3-methylureidophenyl)-5-mercaptotetrazole were added per mole of silver halide.

Still further, to the second, fourth, sixth and seventh layers the addition was made such that 0.2 mg/m$^2$, 0.2 Mg/m$^2$, 0.6 mg/m$^2$ and 0.1 mg/m$^2$, respectively were included.

Still furthermore, to the blue-sensitive emulsion layer and the green-sensitive emulsion layer, $1\times10^{-4}$ mole and $2\times10^{-4}$ mole, respectively, of 4-hydroxy-6-methyl-1,3,3a,7-tetrazaindene were added per mole of silver halide.

Further, to the red-sensitive emulsion layer, 0.05 g/m$^2$ of a copolymer latex of methacrylic acid and butyl acrylate (ratio by mass being 1:1; average molecular weight being 200,000–400,000) was added.

Furthermore, to the second, fourth and sixth layer was added disodium catechol-3,5-disulfonate to make the amount included 6 mg/m$^2$, 6 mg/m$^2$ ad 18 mg/m$^2$, respectively.

With an object of prevention of irradiation, the following dyes were added (figures in the parentheses are coating amounts).

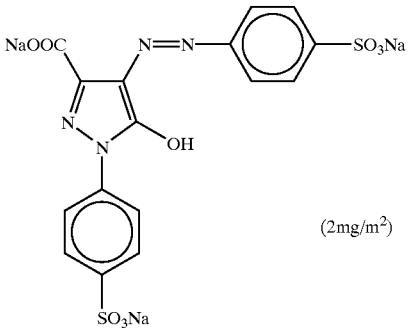

(2mg/m$^2$)

-continued

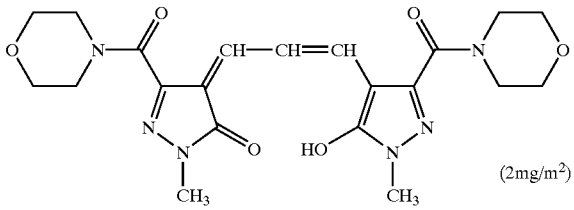

(2mg/m$^2$)

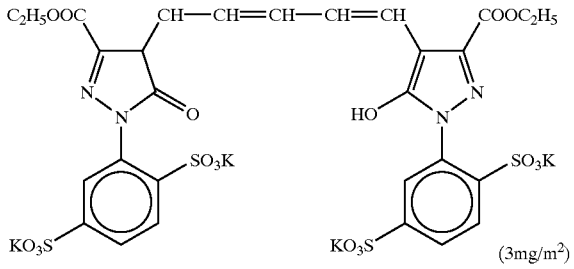

(3mg/m$^2$)

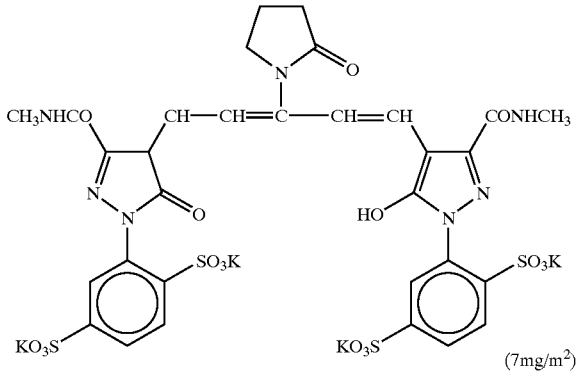

(7mg/m$^2$)

Layer Composition.

As hereunder, composition of each layer will be shown. Figures are the coating amounts (g/m$^2$). Silver halide emulsion is given on the basis of coating amount in terms of silver.

Support.

Paper Laminated with Polyethylene Resin.

[The polyethylene resin on the first layer side contains white pigment (16% by mass of $TiO_2$ and 4% by mass of ZnO), fluorescent whitener (0.03% by mass of 4,4'-bis(5-methylbenzoxazolyl)stilbene and bluing dye (ultramarine)]

First Layer (Blue-sensitive Emulsion Layer)

Emulsion Em-1 [Cubes sensitized with gold and sulfur; a 1:1 (in terms of a molar ratio of silver) mixture of a large particle emulsion having an average grain size of 0.68 $\mu$m and a small particle emulsion having an average grain size of 0.59 $\mu$m; coefficients of variation of the grain size distribution therefor were 0.08 and 0.09, respectively; each of the emulsions contained 0.15 mole % of silver iodide near the surface of the grains and 0.4 mole % of silver bromide was made locally contained on the surface of the grains.]

| | |
|---|---|
| | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |

-continued

| | |
|---|---|
| Color image stabilizer (Cpd-8) | 0.02 |
| Solvent (Solv-1) | 0.21 |
| Second Layer (Color Mixing Inhibiting Layer) | |
| Gelatin | 0.99 |
| Color mixing inhibitor (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| Silver chloride bromide emulsion Em-2 | 0.14 |
| Gelatin | 1.36 |
| Magenta coupler (ExM) | 0.15 |
| Ultraviolet absorber (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Mixing Inhibiting Layer) | |
| Gelatin | 0.71 |
| Color mixing inhibitor (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |

Fifth Layer (Red-sensitive Emulsion Layer)

Silver bromide chloride iodide emulsion Em-3 [Cubes sensitized with gold and sulfur; a 5:5 (in terms of a molar ratio of silver) mixture of a large particle emulsion having an average grain size of 0.40 μm and a small particle emulsion having an average grain size of 0.30 μm; coefficients of variation of the grain size distribution therefor were 0.09 and 0.11, respectively; each of the emulsions contained 0.1 mole % of silver iodide near the surface of the grains and 0.8 mole % of silver bromide was made to be locally contained on the surface of the grains.]

| | |
|---|---|
| | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorber (UV-B) | 0.45 |
| Compound (S1-4) | 0.0015 |
| Solvent (Solv-7) | 0.25 |

-continued

| | |
|---|---|
| Seventh Layer (Protective Layer) | |
| Gelatin | 1.00 |
| Acryl-modified copolymer of polyvinyl alcohol (degree of modification: 17%) | 0.04 |
| Liquid paraffin | 0.02 |
| Surface-active agent (Cpd-13) | 0.01 |

(ExY) Yellow Coupler

A 70:30 mixture (by moles) of the following.

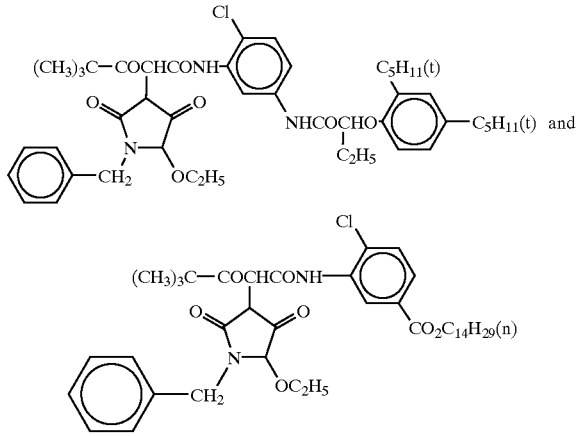

(ExM) Magenta Coupler

A 40:40:20 mixture (by moles) of the following.

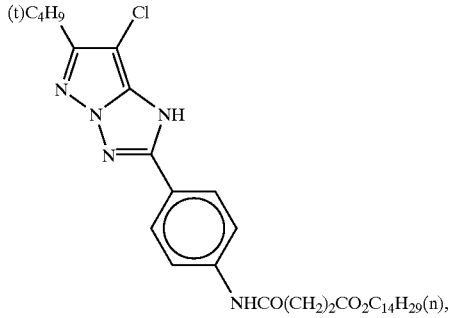

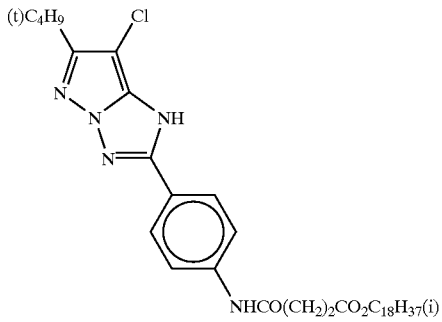

and

-continued

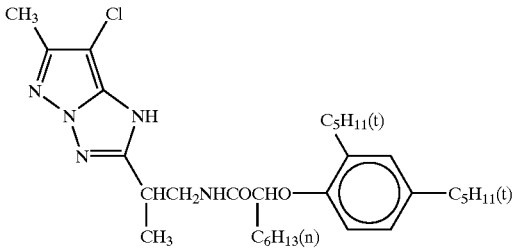

(ExC-2) Cyan Coupler

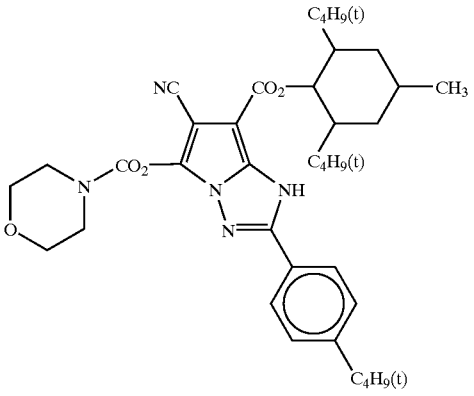

(ExC-3) Cyan Coupler

A 50:25:25 mixture (by moles) of the followings.

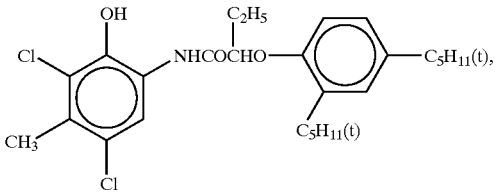

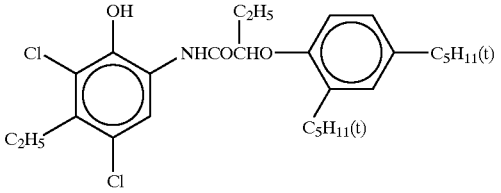

and

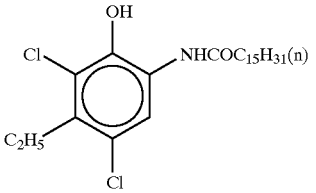

(Cpd-1) Color Image Stabilizer

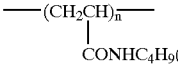

Number-average molecular weight: 60,000

-continued (Cpd-2) Color Image Stabilizer

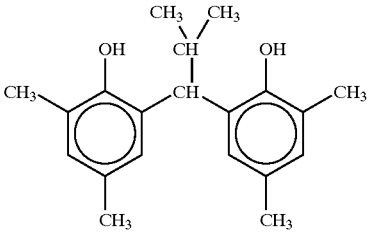

(Cpd-3) Color Image Stabilizer

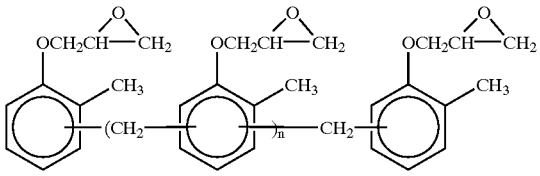

n = 7–8 (in average)

(Cpd-4) Color Mixing Inhibitor

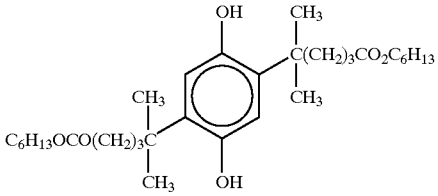

(Cpd-5) Color Image Stabilizer

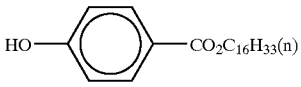

(Cpd-6) Color Image Stabilizer

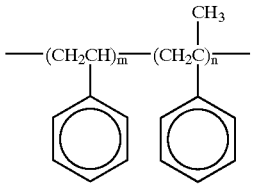

number-average molecular weight: 600
m/n = 10/90

(Cpd-7) Color Image Stabilizer

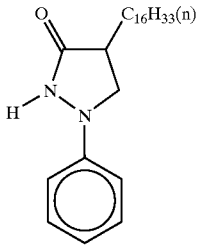

(Cpd-8) Color Image Stabilizer

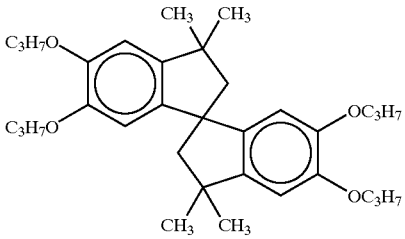

-continued
(Cpd-9) Color Image Stabilizer
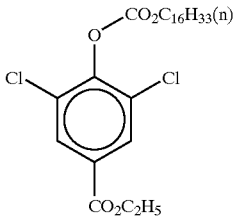
(Cpd-10) Color Image Stabilizer
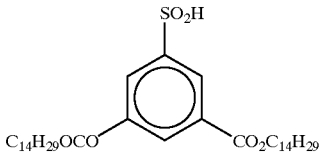
(Cpd-11)
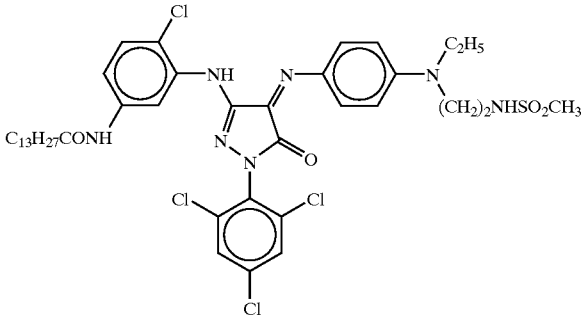
(Cpd-13) Surface-active agent
A 7:3 mixture (by moles) of
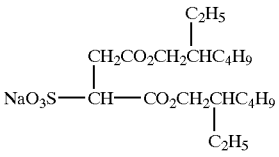
and
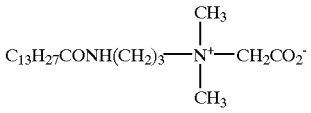
(Cpd-14)
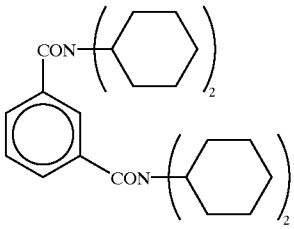
(Cpd-15)
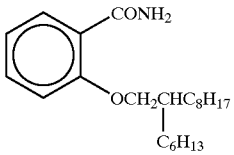
(Cpd-16)
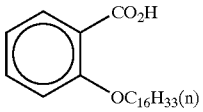
-continued
(Cpd-17)
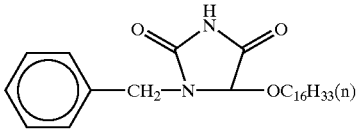
(Cpd-18)
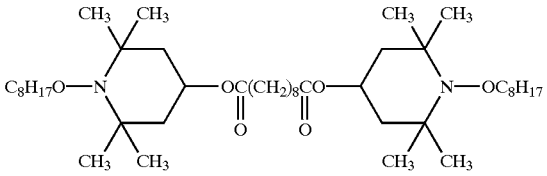
(Cpd-19) Color Mixing Inhibitor
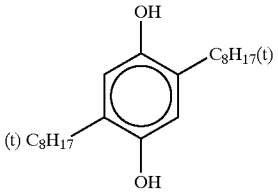
(UV-1) UV Absorber
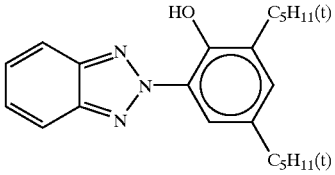
(UV-2) UV Absorber
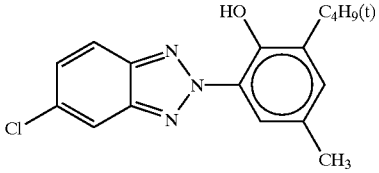
(UV-3) UV Absorber
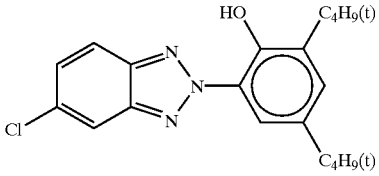
(UV-4) UV Absorber
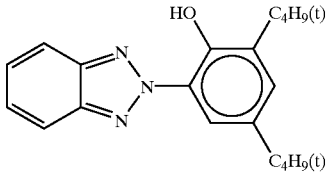
(UV-5) UV Absorber
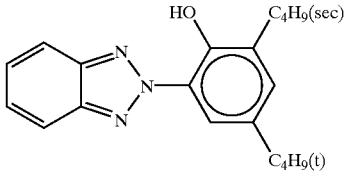

-continued (UV-6) UV Absorber

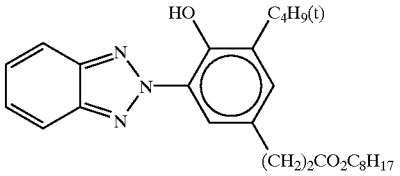

(UV-7) UV Absorbr

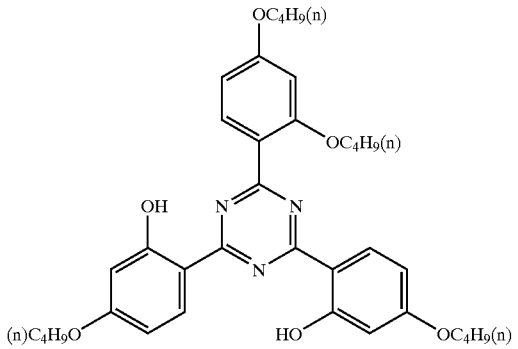

(UV-8) UV Absorber

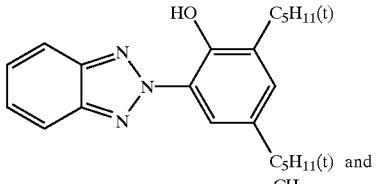

and

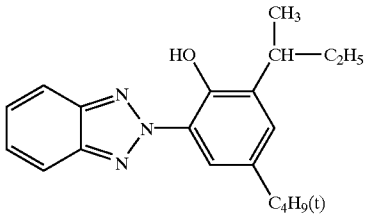

UV-A: A 4:2:2:3 mixture (by mass) of UV-1, UV-2, UV-3 and UV-4

UV-B: A9:3:3:4:5:3 mixture (by mass) of UV-1, UV-2, UV-3, UV-4, UV-5 and UV-6

UV-C: A 1:1:1:2 mixture (by mass) of UV-2, UV-3, UV-6 and UV-7

UV-A': A 4:2:2:3 mixture (by mass) of UV-1, UV-2, UV-3 and UV-8

UV-B': A 9:3:3:4:5:3 mixture (by mass) of UV-1, UV-2, UV-3, UV-8, UV-5 and UV-6

(Solv-1)

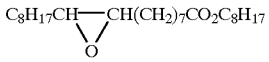

(Solv-2)

A 1:1 mixture (by mass) of the followings.

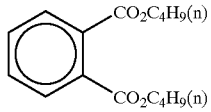

and

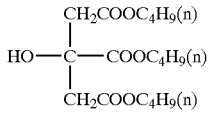

(Solv-3)

$C_4H_9OCO(CH_2)_8CO_2C_4H_9$ (Solv-4)

$O{=}P(OC_6H_{13}(n))_3$ (Solv-5)

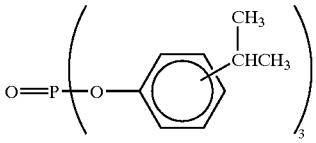

(Solv-7)

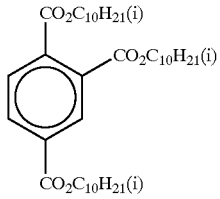

(Solv-8)

$C_8H_{17}OCO(CH_2)_8CO_2C_8H_{17}$ (S1-4)

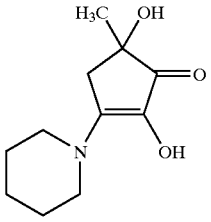

Samples for coating were prepared as above. The samples 101–120 where only the types of the green-sensitive emulsion used were changed were prepared similarly. Contents of the resulting samples are shown in Table 2.

TABLE 2

| | | | Localized AgBr | | | | | Iridium Compound of Formula (II) | | | | |
|---|---|---|---|---|---|---|---|---|---|---|---|---|
| | | | Phase | | Iridium Compound of Formula (I) | | | | Amount | | AgBr | Relation |
| Sample | Emulsion No. | Total Br Content (mol %) | Loc. Br Content (mol %) | Ag Amount Ratio | Compd Type | Amount Added (mol/molAg) | Period Added (%) | Compd Type | Added (mol/molAg) | Period Added (%) | Content upon Addition | with this Application |
| 101 | A-1 | 0.3 | — | <1% | — | — | — | — | — | — | — | CE |
| 102 | A-2 | 0.3 | — | <1% | — | — | — | $K_2[Ir(Cl)_6]$ | $2*10^{-7}$ | 98–100 | 0% | CE |

TABLE 2-continued

| | | | Localized AgBr Phase | | Iridium Compound of Formula (I) | | | Iridium Compound of Formula (II) | | | | |
|---|---|---|---|---|---|---|---|---|---|---|---|---|
| Sample | Emulsion No. | Total Br Content (mol %) | Loc. Br Content (mol %) | Ag Amount Ratio | Compd Type | Amount Added (mol/molAg) | Period Added (%) | Compd Type | Amount Added (mol/molAg) | Period Added (%) | AgBr Content upon Addition | Relation with this Application |
| 103 | A-3 | 0.3 | — | <1% | $K_2[Ir(H_2O)Cl_5]$ | $2*10^{-7}$ | 92–97 | — | — | — | — | CE |
| 104 | A-4 | 0.3 | — | <1% | $K_2[Ir(triazole)Cl_5]$ | $2*10^{-7}$ | 92–97 | — | — | — | — | CE |
| 105 | A-5 | 0.3 | — | <1% | $K_2[Ir(H_2O)Cl_5]$ | $2*10^{-7}$ | 92–97 | $K_2[Ir(Cl)_6]$ | $1*10^{-7}$ | 98-100 | 0% | CE |
| 106 | A-6 | 0.3 | — | <1% | $K_2[Ir(triazole)Cl_5]$ | $2*10^{-7}$ | 92–97 | $K_2[Ir(Cl)_6]$ | $1*10^{-7}$ | 98–100 | 0% | CE |
| 107 | B-1 | 3.3 | 20 | Ca. 15% | — | — | — | — | — | — | — | CE |
| 108 | B-2 | 3.3 | 20 | Ca. 15% | — | — | — | $K_2[Ir(Cl)_6]$ | $2*10^{-7}$ | 98–100 | 20 mol% | CE |
| 109 | B-2-2 | 3.3 | 20 | Ca. 15% | — | — | — | $K_2[Ir(Cl)_6]$ | $1*10^{-7}$ | 98–100 | 20 mol% | CE |
| 110 | B-3 | 3.3 | 20 | Ca. 15% | $K_2[Ir(H_2O)Cl_5]$ | $2*10^{-7}$ | 92–97 | — | — | — | — | CE |
| 111 | B-3-2 | 3.3 | 20 | Ca. 15% | $K_2[Ir(H_2O)Cl_5]$ | $4*10^{-7}$ | 92–97 | — | — | — | — | CE |
| 112 | B-4 | 3.3 | 20 | Ca. 15% | $K_2[Ir(triazole)Cl_5]$ | $2*10^{-7}$ | 92–97 | — | — | — | — | CE |
| 113 | B-5 | 3.3 | 20 | Ca. 15% | $K_2[Ir(H_2O)Cl_5]$ | $2*10^{-7}$ | 92–97 | $K_2[Ir(Cl)_6]$ | $1*10^{-7}$ | 98–100 | 20 mol% | Inv |
| 114 | B-5-2 | 3.3 | 20 | Ca. 15% | $K_2[Ir(H_2O)Cl_5]$ | $2*10^{-7}$ | 92–97 | $K_2[Ir(Cl)_6]$ | $1*10^{-7}$ | 80–82 | 40 mol% | Inv |
| 115 | B-5-3 | 3.3 | 4 | Ca. 15% | $K_2[Ir(H_2O)Cl_5]$ | $2*10^{-7}$ | 92–97 | $K_2[Ir(Cl)_6]$ | $1*10^{-7}$ | 98–100 | 4 mol% | CE |
| 116 | B-5-4 | 3.3 | 20 | Ca. 15% | $K_2[Ir(H_2O)Cl_5]$ | $5*10^{-8}$ | 92–97 | $K_2[Ir(Cl)_6]$ | $2.5*10^{-7}$ | 98–100 | 20 mol% | CE |
| 117 | B-6 | 3.3 | 20 | Ca. 15% | $K_2[Ir(triazole)Cl_5]$ | $2*10^{-7}$ | 92–97 | $K_2[Ir(Cl)_6]$ | $1*10^{-7}$ | 98–100 | 20 mol% | Inv |
| 118 | B-7 | 3.3 | 20 | Ca. 15% | $K_2[Ir(O)Cl_5]$ | $2*10^{-7}$ | 92–97 | $K_2[Ir(Cl)_6]$ | $1*10^{-7}$ | 98–100 | 20 mol% | Inv |
| 119 | B-8 | 3.3 | 30 | Ca. 10% | $K_2[Ir(H_2O)Cl_5]$ | $2*10^{-7}$ | 92–97 | $K_2[Ir(Cl)_6]$ | $1*10^{-7}$ | 82–88 | 30 mol% | Inv |
| 120 | B-9 | 3.3 | 50 | Ca. 6% | $K_2[Ir(H_2O)Cl_5]$ | $2*10^{-7}$ | 92–97 | $K_2[Ir(Cl)_6]$ | $1*10^{-7}$ | 98–100 | 50 mol% | Inv |

CE: Comparative Examples
Inv: The present invention

Experiments and Evaluations

In order to check the photographic characteristic of those samples, the following experiments were carried out.

Gradation exposure for sensitometry was carried out for each coated sample using a sensitometer for high illuminance HIE type (trade name, manufactured by Yamashita Denso KK). An SP-2 filter (trade name, manufactured by Fuji Photo Film) was attached and an exposure to high illuminance was carried out for $10^{-4}$ second. Here, time from the exposure to the after-processing was changed and the latent image stability after the exposure was evaluated. Temperature and humidity during the exposure were controlled at 15° C. and 25% RH and, with regard to the time from the exposure to the after-processing, experiments were carried out under two conditions where the times were 7 seconds and 60 minutes. With regard to the processing, a color developing processing A as shown below was carried out.

There are shown the steps for the processing as follows.

Processing A.

A sample 101 prepared by the use of the emulsion A-1 was made into a roll having a width of 127 mm, subjected to an image-type exposure using a mini-laboratory processor PP1258AR manufactured by Fuji Photo Film and then subjected to a continuous processing (running test) according to the following processing step until twice the volume of the color developing tank was replenished. The processing using this running solution will be referred to as a processing A.

| Processing Step | Temperature | Time | Replenished Volume * |
|---|---|---|---|
| Color Development | 38.5° C. | 45 seconds | 45 ml |
| Bleaching/Fixing | 38.0° C. | 45 seconds | 35 ml |

-continued

| Processing Step | Temperature | Time | Replenished Volume * |
|---|---|---|---|
| Rinse (1) | 38.0° C. | 20 seconds | — |
| Rinse (2) | 38.0° C. | 20 seconds | — |
| Rinse (3) ** | 38.0° C. | 20 seconds | — |
| Rinse (4) ** | 38.0° C. | 30 seconds | 121 ml |

*: Replenished volume per $m^2$ of the photosensitive material
**: A revesed permeation module (trade name: Rinse Cleaning System RC50D; manufactured by Fuji Photo Film) was installed in rinse (3) and a rinsing solution was taken out from the rinse (3) and sent to the RC50D by means of a pump. The permeated water obtained in the vessel was supplied to a rinse (4) and concentrated water was returned to the rinse (3). Pump pressure was adjusted so that the permeated water volume to the inverted permeation module was kept 50–300 ml/minute and circulation was carried out while warming for 10 hours per day. (Rinsing was carried out in a counter-current system of tanks (1) to (4).)

Composition of each of the processing solutions is as follows.

| [Color Developing Solution] | [Tank Soln] | [Supplement g Soln] |
|---|---|---|
| Water | 800 ml | 800 ml |

Surface-active agent of a dimethylpolysiloxane type (trade name: Silicone KF 351A, manufactured by

| | | |
|---|---|---|
| Surface-active agent of a dimethylpolysiloxane type (trade name: Silicone KF 351A, manufactured by Shinetsu Chemical) | 0.1 g | 0.1 g |
| Tri(isopropanol)amine | 8.8 g | 8.8 g |

-continued

| | | |
|---|---|---|
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1-disulfonate | 0.5 g | 0.5 g |
| Potassium chloride | 10.0 g | — |
| Potassium bromide | 0.040 g | 0.010 g |
| Fluorescent whitener of a tri-aziridinylstilbene type (trade name: Hakkol FWA-SF; manufactured by Showa Kagaku) | 2.5 g | 2.5 g |
| Sodium sulfite | 0.1 g | 0.1 g |
| Disodium N,N-bis(sulfonato-ethyl)hydroxylamine | 8.5 g | 11.1 g |
| N-Ethyl-N-(β-methanesulfonamidoethyl)-3-methyl-4-amino-4-aminoaniline 3/2 sulfate monohydrate | 5.0 g | 15.7 g |
| Potassium carbonate | 26.3 g | 26.3 g |
| Water was added to make | 1000 ml | 1000 ml |
| pH (25° C./adjusted by potassium and sulfuric acid) | 10.15 | 12.50 |

| [Bleaching/Fixing Solution] | [Tank Soln] | [Supple-ment g Soln] |
|---|---|---|
| Water | 700 ml | 600 ml |
| Iron (III) ammonium ethylene-diamine tetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 33.0 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water was added to make | 1000 ml | 1000 ml |
| pH (25° C./adjusted by acetic acid and ammonia) | 6.0 | 6.0 |

| [Rinse Soln] [Replenishing Soln] | [Tank Soln] | |
|---|---|---|
| Sodium chlorinated iso-cyanurate | 0.02 g | 0.02 g |
| Deionized water (electro-conductivity ≦ 5 μS/cm) | 1000 ml | 1000 ml |
| pH | 6.5 | 6.5 |

Evaluation of suitability for High Intensity Exposure.

Color density of each sample when subjected to a processing at 60 minutes after exposure was measured and there were determined the exposure dose (exposure dose A) giving color density of 0.5 higher than the lowest color density and the exposure dose (exposure dose B) giving color density of 2.0 higher than the lowest color density (density of about 90% of the highest density) whereupon the following assessment was carried out. The result is shown in Table 3.

| [Exposure Dose B/ Exposure Dose A] | [Asess-ment] | [Suitability for High Illuminance Exp.] |
|---|---|---|
| 4.0 or less | ◎ | preferred level |
| 4.0–6.0 | ○ | no problems |
| 6.0–10.00 | Δ | few problems |
| 10.0 or more | X | problems |

Evaluation of Stability of Latent Image

Sensitivity was measured for each of the samples which was subjected to a processing at 60 minutes after exposure and at 7 seconds after exposure. Here, the sensitivity is a exposure dose giving a color density of 0.5 higher than the lowest color density. There were determined the exposure dose (exposure dose A) when the processing was carried out at 60 minutes after exposure and the exposure dose (exposure dose C) when the processing was carried out at 7 seconds after exposure whereupon the following assessment was carried out.

| [Exposure Dose C/ Exposure Dose A] | [Asses-ment] | [Stability of Latent Image] |
|---|---|---|
| 1.050 or less | ◎ | preferred level |
| 1.050–1.100 | ○ | no problems |
| 1.100–1.200 | Δ | few problems |
| 1.200 or more | X | problems |

Evaluation of Sensitivity

For each of the samples, a reciprocal of the exposure dose A was calculated and sensitivity for each sample was determined in terms of a relative value where the value for the sample 102 was defined as 100.

The above results are shown in Table 3.

TABLE 3

| Sample No. | Emulsion No. | Aptitude for High intensity exposure | Stability of Latent Image: Sensitivity Variation after Exposure | Stability of Latent Image: Assessment | Relative Sensitivity | Relation to this Invention |
|---|---|---|---|---|---|---|
| 101 | A-1 | X | 1.023 | ◎ | 141.3 | Comp.Ex. |
| 102 | A-2 | ○ | 1.660 | X | 100.0 | Comp.Ex. |
| 103 | A-3 | X | 1.072 | ○ | 134.9 | Comp.Ex. |
| 104 | A-4 | X | 1.084 | ○ | 131.8 | Comp.Ex. |
| 105 | A-5 | ○ | 1.208 | Δ | 93.3 | Comp.Ex. |
| 106 | A-6 | ○ | 1.230 | Δ | 89.1 | Comp.Ex. |
| 107 | B-1 | X | 1.023 | ◎ | 177.8 | Comp.Ex. |
| 108 | B-2 | ○ | 1.076 | Δ | 158.5 | Comp.Ex. |
| 109 | B-2-2 | Δ | 1.047 | ◎ | 166.0 | CompEx. |
| 110 | B-3 | Δ | 1.052 | ○ | 177.8 | Comp.Ex. |
| 111 | B-3-2 | Δ | 1.076 | ○ | 120.2 | Comp.Ex. |
| 112 | B-4 | Δ | 1.084 | Δ | 158.5 | Comp.Ex. |
| 113 | B-5 | ◎ | 1.050 | ◎ | 158.5 | This invn. |
| 114 | B-5-2 | ○ | 1.905 | X | 93.3 | Comp.Ex. |
| 115 | B-5-3 | ○ | 1.995 | X | 104.7 | Comp.Ex. |

TABLE 3-continued

| Sample No. | Emulsion No. | Aptitude for High intensity exposure | Stability of Latent Image: Sensitivity Variation after Exposure | Stability of Latent Image: Assessment | Relative Sensitivity | Relation to this Invention |
|---|---|---|---|---|---|---|
| 116 | B-5-4 | ◎ | 1.009 | ◎ | 123.0 | This Invn. |
| 117 | B-6 | ○ | 1.057 | ○ | 151.4 | This Invn. |
| 118 | B-7 | ○ | 1.052 | ○ | 151.4 | This Invn. |
| 119 | B-8 | ○ | 1.042 | ◎ | 131.8 | This Invn. |
| 120 | B-9 | ○ | 1.047 | ◎ | 120.2 | This Invn. |

There is shown an excellent advantage of the present invention in the result of Table 3. Thus, in the samples where only the iridium compound represented by the formula (II) according to the present invention was used as an iridium compound, it was not possible to achieve both preferred high intensity exposure aptitude and latent image stability even when there was a localized silver bromide phase satisfying the range of the present invention. When the amount of the iridium compound was adjusted in that case, only a region where only one of high intensity exposure aptitude and latent image stability was satisfied (samples 108 and 109) was seen.

On the other hand, in the samples using an emulsion containing only the iridium compound represented by the formula (I) of the present invention, although there was no problem in terms of latent image stability, the high intensity exposure aptitude was insufficient and there was a problem that, when the amount of the iridium compound was increased, the sensitivity lowered (samples 110, 111, etc.).

Even in emulsions where both iridium compounds represented by the formulae (I) and (II) were used, satisfaction of both high intensity exposure aptitude and latent image stability was still insufficient when an emulsion having no localized silver bromide phase of the present invention was used (samples 105 and 106).

Thus, both high intensity exposure aptitude and latent image stability were satisfactory only in such a case where a sample used an emulsion containing both iridium compounds represented by the formulae (I) and (II) and where the sample contained a localized silver bromide phase of the present invention (samples 113 and 116–120).

However, even in the samples of the present invention satisfying both high intensity exposure aptitude and latent image stability, there was a tendency for sensitivity to be somewhat lowered when the amount of the iridium compound represented by the formula (I) was little as compared with the amount of the iridium compound represented by the formula (II) or when the local silver bromide content of the localized silver bromide phase was relatively high.

Example 2

Samples where the layers were made thin were prepared by changing the layer composition in the above-mentioned Example 1 as follows and the same experiments as in Example 1 were carried out for those samples. The result was as same as that in Example 1 and the advantage of the present invention was also seen even in the ultra-quick processing of the samples where the layers were made thin.

Preparation of Samples.

| | |
|---|---|
| **First Layer (Blue-Sensitive Emulsion Layer)** | |
| Emulsion | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| **Second Layer (Color Mixing Inhibiting Layer)** | |
| Gelatin | 0.60 |
| Color mixing inhibitor (Cpd-19) | 0.09 |
| Color image stabilizer (Cpd-5) | 0.007 |
| Color image stabilizer (Cpd-7) | 0.007 |
| Ultraviolet absorber (UV-C) | 0.05 |
| Solvent (Solv-5) | 0.11 |
| **Third Layer (Green-Sensitive Emulsion Layer)** | |
| Silver chloride bromide emulsion Em-2 (the same emulsion as in Example 1) | 0.14 |
| Gelatin | 0.73 |
| Magenta coupler (ExM) | 0.15 |
| Ultraviolet absorber (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| **Fourth Layer (Color Mixing Inhibiting Layer)** | |
| Gelatin | 0.48 |
| Color mixing inhibitor (Cpd-4) | 0.07 |
| Color image stabilizer (Cpd-5) | 0.006 |
| Color image stabilizer (Cpd-7) | 0.006 |
| Ultraviolet absorber (UV-C) | 0.04 |
| Solvent (Solv-5) | 0.09 |
| **Fifth Layer (Red-Sensitive Emulsion Layer)** | |
| Silver chloride bromide iodide emulsion Em-3 (the same emulsion as in Example 1) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorber (UV-7) | 0.02 |
| Solvent (Solv-5) | 0.09 |
| **Sixth Layer (Ultraviolet Absorbing Layer)** | |
| Gelatin | 0.32 |
| Ultraviolet absorber (UV-C) | 0.42 |
| Solvent (Solv-7) | 0.08 |

-continued

| Seventh Layer (Protective Layer) | |
|---|---|
| Gelatin | 0.70 |
| Acryl-modified copolymer of polyvinyl alcohol (degree of modification: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

Each of the prepared samples was exposed to the same light as in the experiment in Example 1 and, with regard to a color development processing, an ultra-quick processing was carried out according to the following development processing B.

Processing B.

The above photosensitive material sample was made into a roll having a width of 127 mm and the photosensitive material sample was subjected to an imagewise exposure from a negative film of an average density using an experimental processing apparatus prepared by modification of a mini-laboratory processor (trade name: PP350; manufactured by Fuji Photo Film) so that processing time and processing temperature could be changed and the photosensitive material sample subjected to a continuous processing (running test) until the volume of the color development replenishing solution used in the following processing step became half of the capacity of the color developing tank. The processing using this running solution will be referred to as a processing B.

| Processing Step | Temperature | Time | Volume Replenished* |
|---|---|---|---|
| Color Development | 45.0° C. | 15 seconds | 45 ml |
| Bleaching | 40.0° C. | 15 seconds | 35 ml |
| Rinse (1) | 40.0° C. | 8 seconds | — |
| Rinse (2) | 40.0° C. | 8 seconds | — |
| Rinse (3) ** | 40.0° C. | 8 seconds | — |
| Rinse (4) ** | 38.0° C. | 8 seconds | 121 ml |
| Drying | 80° C. | 15 seconds | |

*: Replenished volume per $m^2$ of the photosensitive material
**: A revesed permeation module (trade name: Rinse Cleaning System RC50D; manufactured by Fuji Photo Film) was installed in rinse (3) and a rinsing solution was taken out from the rinse (3) and sent to the RC50D by means of a pump. The permeated water obtained in the vessel was supplied to a rinse (4) and concentrated water was returned to the rinse (3). Pump pressure was adjusted so that the permeated water volume to the inverted permeation module was kept 50–300 ml/minute and circulation was carried out while warming for 10 hours per day. Rinsing was carried out in a four-tank (1–4) counter-current system.

Composition of each of the processing solutions is as follows.

| [Color Developing Solution] | [Tank Soln] | [Supplement g Soln] |
|---|---|---|
| Water | 800 ml | 600 ml |
| Fluorescent whitener (FL-1) | 5.0 g | 8.5 g |
| Tri(isopropanol) amine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium N,N-bis (sulfonatoethyl) hydroxylamine | 8.5 g | 14.5 g |
| 4-Amino-3-methyl-N-ethyl-N-(β-methanesulfonamidoethyl)-aniline 3/2 sulfate monohydrate | 10.0 g | 22.0 g |
| Potassium carbonate | 26.3 g | 26.3 g |
| Water was added to make | 1000 ml | 1000 ml |
| pH (25° C./adjusted by potassium and sulfuric acid) | 10.35 | 12.6 |

| [Bleaching/Fixing Solution] | [Tank Soln] | [Supplement g Soln] |
|---|---|---|
| Water | 800 ml | 800 ml |
| Ammonium thiosulfate (750 g/l) | 107 ml | 214 ml |
| Succinic acid | 29.5 g | 59.0 g |
| Iron (III) ammonium ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water was added to make | 1000 ml | 1000 ml |
| pH (25° C./adjusted by nitric acid and ammonia) | 6.00 | 6.00 |

| [Rinse Soln] | [Tank Soln] | [Replenishing Soln] |
|---|---|---|
| Sodium chlorinated iso-cyanurate | 0.02 g | 0.02 g |
| Deionized water (electroconductivity ≦ 5 μS/cm) | 1000 ml | 1000 ml |
| pH | 6.5 | 6.5 |

FL-1

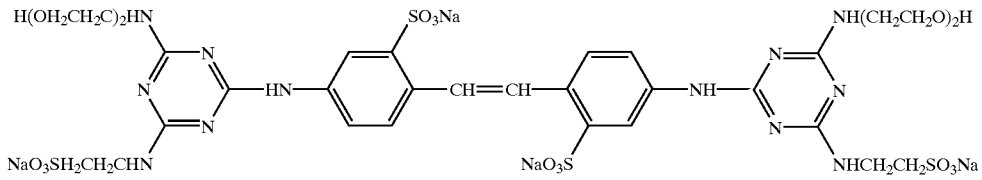

Example 3

When the same evaluation as in Example 1 was carried out except that the method of exposure for the sample as described in Example 1 was changed to the following scanning exposure, it was confirmed that the same advantage as in Example 1 was also achieved by the samples of the invention. Thus, even when sensitivity was determined by a sensitometry by scanning exposure, it was shown that stability of the coated solution with a lapse of time was improved in the samples of the present invention.

As to the scanning exposure of the sample, the same apparatus as described in FIG. 1 of the Japanese Patent Laid-Open No. 8-16238 was used. With regard to a light source, a second harmonic generator (SHG) where a semiconductor having an oscillation wavelength of about 688 nm and a non-linear optical crystals were combined was used to give laser beam of 473 nm and the laser beam was scanned by a rotary polyhedron and, at the same time, the sample was moved in a direction of rotational axis of the rotating polyhedron to carry out a scanning exposure. With regard to an exposure dose, intensity of laser beam was continuously modulated using a sonic optical element together with movement of the photosensitive material so that an adjustment was done whereby it was possible to continuously achieve from the minimum color density to the maximum color density.

At that time, the scanning exposure was done at 400 dpi and the average exposure time per pixel was about $8\times10^{-8}$ seconds. In addition, in order to suppress the changes in quantity of light due to the temperature of the semiconductor laser, temperature was kept constant using a Peltier element.

Example 4

Evaluation was carried out for the samples in Examples 1–3 where each of the ultraviolet absorbers used there (UV-A and UV-B) was substituted with UV-A' and UV-B', respectively, in which only UV-4 contained as a part of the mixing components therein was substituted with the same mass of UV-8. As a result, it was confirmed that the same result as in Examples 1–3 was achieved.

Example 5

Preparation of Emulsion A.

A 3% aqueous solution of lime-treated gelatin (1000 ml) was adjusted to pH 3.3 and pC 11.7 and an aqueous solution containing 2.12 moles of silver nitrate and an aqueous solution containing 2.2 moles of sodium chloride were added thereto and mixed therewith at the same time while stirring vigorously. After a desalting processing was carried out at 40° C., 168 g of lime-treated gelatin were added and then adjusted to have a pH of 5.7 and a pC of 11.8. There was obtained an emulsion of cubic silver chloride where the resulting grains had a side length of 0.6 μm and variation coefficient of 11%.

After that, this was dissolved at 40° C., sodium thiosulfonate was added in an amount of $2\times10^{-5}$ mol per mole of silver halide and an emulsion of fine grains (average grain size being 0.05 μm) (fine particle emulsion A-7) of 70 mole % silver bromide and 30 mole % of silver chloride was added to make the silver amount 1%. Then there were added sodium thiosulfate in an amount of $2\times10^{-6}$ mole per mole of silver halide and the following compound S-2 in an amount of $1.2\times10^{-5}$ mole per mole of silver halide as a gold sensitizer and then aged at 60° C. for 40 minutes.

After cooled down to 40° C., the above sensitizing dye A', the above sensitizing dye B', 1-phenyl-5-mercaptotetrazole, 1-(5-methylureidophenyl)-5-mercaptotetrazole and potassium bromide were added thereto in amounts of $2\times10^{-4}$ mole, $1\times10^{-4}$ mole, $2\times10^{-4}$ mole, $2\times10^{-4}$ mole and $2\times10^{-3}$ mole, respectively, per mole of silver halide.

S-2

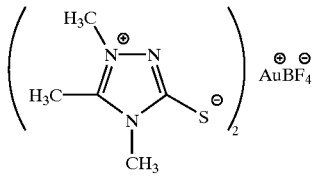

Sensitizing dye A'

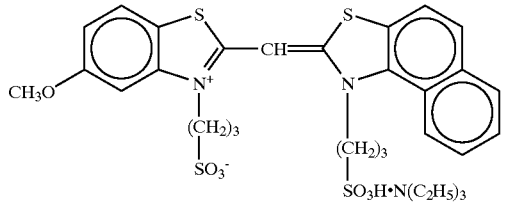

Sensitizing dye B'

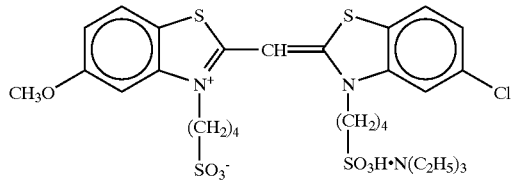

Preparation of Emulsion B.

An emulsion was prepared which was different from the emulsion A only in the following respect that, at the stage when addition of silver nitrate was 90% complete, an aqueous solution of silver iodide was added while mixing vigorously so that the amount of I per mole of the resulting silver halide was made 0.25 mole. There was obtained an emulsion of cubic silver chloride iodide bromide where the resulting grains had a side length of 0.6 μm and variation coefficient of 11%.

Preparation of Emulsion C.

An emulsion was prepared which was different from the emulsion B only in the following respect that, at the stage when addition of silver nitrate was from 70% to 85%, an aqueous solution of $K_2[IrCl_6]$ was added so that the amount of Ir per mole of the resulting silver halide was made $2\times10^{-8}$ mole. There was obtained an emulsion of cubic silver chloride iodide bromide where the resulting grains had a side length of 0.6 μm and variation coefficient of 11%.

Preparation of Emulsion D.

An emulsion was prepared which was different from the emulsion B only in the following respect that, at the stage when addition of silver nitrate was from 70% to 85% complete, an aqueous solution of $K_2[IrCl_6]$ was added so that the amount of Ir per mole of the resulting silver halide was made $5\times10^{-8}$ mole. There was obtained an emulsion of cubic silver chloride iodide bromide where the resulting grains had a side length of 0.6 μm and variation coefficient of 11%.

Preparation of Emulsion E.

An emulsion was prepared which was different from the emulsion D only in the following respect that, a fine grain emulsion (average grain size being 0.05 μm) comprising 70 mole % of silver bromide and 30 mole % of silver chloride and which was doped with $K_2$ [$IrCl_6$] was added instead of the fine particle emulsion A-7 so that the amount of $K_2[IrCl_6]$ was made $2\times10^{-8}$ mole per mole of silver halide. There was obtained an emulsion of cubic silver chloride iodide bromide where the resulting grains had a side length of 0.6 μm and variation coefficient of 11%.

Preparation of Emulsion F.

An emulsion was prepared which was different from the emulsion D only in the following respect that, a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $5\times10^{-8}$ mole per mole of silver halide. There was obtained an emulsion of cubic silver chloride iodide bromide where the resulting grains had a side length of 0.6 μm and variation coefficient of 11%.

Preparation of Emulsion G.

An emulsion was prepared which was different from the emulsion D only in the following respect that, a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $2\times10^{-7}$ mole per mole of silver halide. There was obtained an emulsion of cubic silver chloride iodide bromide where the resulting grains had a side length of 0.6 μm and variation coefficient of 11%.

Preparation of Emulsion H.

An emulsion was prepared which was different from the emulsion B only in the following respect that, at the stage when addition of silver nitrate was from 70% to 85% complete, an aqueous solution of $K_2[IrCl_6]$ was added so that the amount of Ir per mole of the resulting silver halide was made $1\times10^{-7}$ mole. There was obtained an emulsion of cubic silver chloride iodide bromide where the resulting grains had a side length of 0.6 μm and variation coefficient of 11%.

Preparation of Emulsion I.

An emulsion was prepared which was different from the emulsion B only in the following respect that, at the stage when addition of silver nitrate was from 70% to 85% complete, an aqueous solution of $K_2[Ir(H_2O)Cl_5]$ was added so that the amount of Ir per mole of the resulting silver halide was made $2\times10^{-7}$ mole. There was obtained an emulsion of cubic silver chloride iodide bromide where the resulting grains had a side length of 0.6 μm and variation coefficient of 11%.

Preparation of Emulsion J.

An emulsion was prepared which was different from the emulsion B only in the following respect that, at the stage when addition of silver nitrate was from 70% to 85%, an aqueous solution of $K_2[Ir(H_2O)Cl_5]$ was added so that the amount of Ir per mole of the resulting silver halide was made $5\times10^{-7}$ mole. There was obtained an emulsion of cubic silver chloride iodide bromide where the resulting grains had a side length of 0.6 μm and variation coefficient of 11%.

Preparation of Emulsion K.

An emulsion was prepared which was different from the emulsion J only in the following respect that a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $5\times10^{-9}$ mole per mole of silver halide. There was obtained an emulsion of cubic silver chloride iodide bromide where the resulting grains had a side length of 0.6 μm and variation coefficient of 11%.

Preparation of Emulsion L.

An emulsion was prepared which was different from the emulsion J only in the following respect that a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $2\times10^{-8}$ mole per mole of silver halide. There was obtained an emulsion of cubic silver chloride iodide bromide where the resulting grains had a side length of 0.6 μm and variation coefficient of 11%.

Preparation of Emulsion M.

An emulsion was prepared which was different from the emulsion J only in the following respect that a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $5\times10^{-8}$ mole per mole of silver halide. There was obtained an emulsion of cubic silver chloride iodide bromide where the resulting grains had a side length of 0.6 μm and variation coefficient of 11%.

Preparation of Emulsion N.

An emulsion was prepared which was different from the emulsion J only in the following respect that a fine particle emulsion (average grain size being 0.05 μm) comprising 70 mole % of silver bromide and 30 mole % of silver chloride and which was doped with $K_2$ [$IrCl_6$] was added instead of the fine particle emulsion A-7 so that the amount of $K_2[IrCl_6]$ was made $1\times10^{-7}$ mole per mole of silver halide. There was obtained an emulsion of cubic silver chloride iodide bromide where the resulting grains had a side length of 0.6 μm and variation coefficient of 11%.

Preparation of Emulsion O.

An emulsion was prepared which was different from the emulsion J only in the following respect that a fine particle emulsion (average grain size being 0.05 μm) comprising 70 mole % of silver bromide and 30 mole % of silver chloride and which was doped with $K_2$ [$IrCl_6$] was added instead of the fine particle emulsion A-7 so that the amount of $K_2[IrCl_6]$ was made $5\times10^{-7}$ mole per mole of silver halide. There was obtained an emulsion of cubic silver chloride iodide bromide where the resulting grains had a side length of 0.6 μm and variation coefficient of 11%.

Preparation of Emulsion P.

An emulsion was prepared which was different from the emulsion J only in the following respect that a fine particle emulsion (average grain size being 0.05 μm) comprising 70 mole % of silver bromide and 30 mole % of silver chloride and which was doped with $K_2[IrCl_6]$ was added instead of the fine particle emulsion A-7 so that the amount of $K_2[IrCl_6]$ was made $2\times10^{-6}$ mole per mole of silver halide. There was obtained an emulsion of cubic silver chloride iodide bromide where the resulting grains had a side length of 0.6 μm and variation coefficient of 11%.

Preparation of Emulsion Q.

An emulsion was prepared which was different from the emulsion N only in the following respect that a fine particle emulsion (average grain size being 0.08 μm) comprising 30 mole % of silver bromide and 70 mole % of silver chloride and which was doped with $K_2[IrCl_6]$ was added instead of a fine particle emulsion (average grain size being 0.05 μm) comprising 70 mole % of silver bromide and 30 mole % of silver chloride and which was doped with $K_2[IrCl_6]$ There was obtained an emulsion of cubic silver chloride iodide bromide where the resulting grains had a side length of 0.6 μm and variation coefficient of 11%.

Preparation of Emulsion R.

An emulsion was prepared which was different from the emulsion N only in the following respect that a fine particle emulsion (average grain size being 0.08 μm) comprising 50 mole % of silver bromide and 50 mole % of silver chloride and which was doped with $K_2[IrCl_6]$ was added instead of a fine particle emulsion (average grain size being 0.05 μm) comprising 70 mole % of silver bromide and 30 mole % of silver chloride doped with $K_2[IrCl_6]$. There was obtained an emulsion of cubic silver chloride iodide bromide where the resulting grains had a side length of 0.6 μm and a variation coefficient of 11%.

Preparation of Emulsion S.

An emulsion was prepared which was different from the emulsion N only in the following respect that a fine particle emulsion (average grain size being 0.05 μm) comprising 100 mole % of silver bromide and which was doped with $K_2[IrCl_6]$ was added instead of a fine particle emulsion (average grain size being 0.05 μm) comprising 70 mole % of silver bromide and 30 mole % of silver chloride and doped with $K_2[IrCl_6]$. There was obtained an emulsion of cubic silver chloride iodide bromide where the resulting grains had a side length of 0.6 μm and variation coefficient of 11%.

Preparation of Emulsion T.

An emulsion was prepared which was different from the emulsion B only in the following respect that, at the stage when addition of silver nitrate was from 70% to 85% complete, an aqueous solution of $K_2[Ir(H_2O)Cl_5]$ was added so that the amount of Ir per mole of the resulting silver halide was made $1\times10^{-6}$ mole. There was obtained an emulsion of cubic silver chloride iodide bromide where the resulting grains had a side length of 0.6 μm and variation coefficient of 11%.

Preparation of Emulsion U.

An emulsion was prepared which was different from the emulsion B only in the following respect that, at the stage when addition of silver nitrate was from 70% to 85% complete, an aqueous solution of $K_2[Ir(H_2O)Cl_5]$ was added so that the amount of Ir per mole of the resulting silver halide was made $5\times10^{-6}$ mole. There was obtained an emulsion of cubic silver chloride iodide bromide where the resulting grains had a side length of 0.6 μm and variation coefficient of 11%.

Preparation of Emulsion V.

An emulsion was prepared which was different from the emulsion J only in the following respect that the amount of an aqueous solution of $K_2[Ir\ (H_2O)\ Cl_5]$ added when silver nitrate was added was changed so that the amount of Ir to 1 mole of silver halide was made $2\times10^{-5}$ mole and that a fine particle emulsion of $K_2[Ir(H_2O)Cl_5]$ (average grain size being 0.05 μm) comprising 70 mole % of silver bromide and 30 mole % of silver chloride and which was doped with $K_2[Ir(H_2O)Cl_5]$ was added instead of a fine particle emulsion A-7 so that the amount of $K_2\ [Ir\ (H_2O)\ Cl_5]$ per mole of the resulting silver halide was made $5\times10^{-8}$ mole. There was obtained an emulsion of cubic silver chloride iodide bromide where the resulting grains had a side length of 0.6 μm and variation coefficient of 11%.

The emulsions prepared as above are shown in the following Table 4.

TABLE 4

| | Silver Halide | | | Fine Particle Emulsion | | |
|---|---|---|---|---|---|---|
| | Iridium in Silver Chloride | | | Iridium in Fine Particles | | |
| Emulsion | Compound | Amount Added (mol/AgX · mol) | Halogen Composition in Fine Particles | Compound | Amount Added (mol/AgX · mol) | Silver Iodide Content (mole %) |
| A | — | — | $Br_{70}Cl_{30}$ | — | — | 0 |
| B | — | — | $Br_{70}Cl_{30}$ | — | — | 0.25 |
| C | $K_2[IrCl_6]$ | $2\times10^{-8}$ | $Br_{70}Cl_{30}$ | — | — | 0.25 |
| D | $K_2[IrCl_6]$ | $5\times10^{-8}$ | $Br_{70}Cl_{30}$ | — | — | 0.25 |
| E | $K_2[IrCl_6]$ | $5\times10^{-8}$ | $Br_{70}Cl_{30}$ | $K_2[IrCl_6]$ | $2\times10^{-8}$ | 0.25 |
| F | $K_2[IrCl_6]$ | $5\times10^{-8}$ | $Br_{70}Cl_{30}$ | $K_2[IrCl_6]$ | $5\times10^{-8}$ | 0.25 |
| G | $K_2[IrCl_6]$ | $5\times10^{-8}$ | $Br_{70}Cl_{30}$ | $K_2[IrCl_6]$ | $2\times10^{-7}$ | 0.25 |
| H | $K_2[IrCl_6]$ | $1\times10^{-7}$ | $Br_{70}Cl_{30}$ | — | — | 0.25 |
| I | $K_2[Ir(H_2O)Cl_5]$ | $2\times10^{-7}$ | $Br_{70}Cl_{30}$ | — | — | 0.25 |
| J | $K_2[Ir(H_2O)Cl_5]$ | $5\times10^{-7}$ | $Br_{70}Cl_{30}$ | — | — | 0.25 |
| K | $K_2[Ir(H_2O)Cl_5]$ | $5\times10^{-7}$ | $Br_{70}Cl_{30}$ | $K_2[IrCl_6]$ | $5\times10^{-9}$ | 0.25 |
| L | $K_2[Ir(H_2O)Cl_5]$ | $5\times10^{-7}$ | $Br_{70}Cl_{30}$ | $K_2[IrCl_6]$ | $2\times10^{-8}$ | 0.25 |
| M | $K_2[Ir(H_2O)Cl_5]$ | $5\times10^{-7}$ | $Br_{70}Cl_{30}$ | $K_2[IrCl_6]$ | $5\times10^{-8}$ | 0.25 |
| N | $K_2[Ir(H_2O)Cl_5]$ | $5\times10^{-7}$ | $Br_{70}Cl_{30}$ | $K_2[IrCl_6]$ | $1\times10^{-7}$ | 0.25 |
| O | $K_2[Ir(H_2O)Cl_5]$ | $5\times10^{-7}$ | $Br_{70}Cl_{30}$ | $K_2[IrCl_6]$ | $5\times10^{-7}$ | 0.25 |
| P | $K_2[Ir(H_2O)Cl_5]$ | $5\times10^{-7}$ | $Br_{70}Cl_{30}$ | $K_2[IrCl_6]$ | $2\times10^{-6}$ | 0.25 |
| Q | $K_2[Ir(H_2O)Cl_5]$ | $5\times10^{-7}$ | $Br_{30}Cl_{70}$ | $K_2[IrCl_6]$ | $1\times10^{-7}$ | 0.25 |
| R | $K_2[Ir(H_2O)Cl_5]$ | $5\times10^{-7}$ | $Br_{50}Cl_{50}$ | $K_2[IrCl_6]$ | $1\times10^{-7}$ | 0.25 |
| S | $K_2[Ir(H_2O)Cl_5]$ | $5\times10^{-7}$ | $Br_{100}$ | $K_2[IrCl_6]$ | $1\times10^{-7}$ | 0.25 |
| T | $K_2[Ir(H_2O)Cl_5]$ | $1\times10^{-6}$ | $Br_{70}Cl_{30}$ | — | — | 0.25 |
| U | $K_2[Ir(H_2O)Cl_5]$ | $5\times10^{-6}$ | $Br_{70}Cl_{30}$ | — | — | 0.25 |
| V | $K_2[Ir(H_2O)Cl_5]$ | $2\times10^{-5}$ | $Br_{70}Cl_{30}$ | $K_2[IrCl_6]$ | $5\times10^{-8}$ | 0.25 |

Sample specimens of the silver halide color photographic material were prepared using each of the above emulsion in the same manner as in Example 1. Coating solutions for each of the photographic composition layers were prepared as follows.

Preparation of Coating Solution for First Layer.

The emulsified dispersion A in Example 1 and the chemically sensitized emulsion A were mixed and dissolved to prepare a coating solution for formation of the first layer [coating solution for the first layer (blue-sensitive emulsion layer)]. Incidentally, the coating amount of the emulsion indicates the calculated coating amount of silver.

Coating solutions for formation of the second to the seventh layers (coating solutions for the second to the seventh layers) were also prepared by the same method as in the case of the coating solution for the first layer. A gelatin hardener for each layer was used in the same manner as in Example 1. Further, each of the following Ab-1, Ab-2, Ab-3 and Ab-4 was added to each layer in the same manner as in Example 1.

The sensitizing dyes D, E and F were added to a silver chloride bromide emulsion for formation of the third layer (green-sensitive emulsion layer); the sensitizing dyes G and H and the compound I were added to a silver chloride bromide emulsion for formation of the fifth layer (red-sensitive emulsion layer); and 1-(3-methylureidophenyl-5-mercaptotetrazole, 4-hydroxy-6-methyl-1,3,3a,7-tetrazaindene, the above-mentioned copolymer latex, disodium catachol-3,5-disulfonate and the above-mentioned irradiation inhibiting dye were added to each layer in the same composition as in Example 1.

Layer Composition

Composition of each layer was formed in the same manner as in Example 1 except that the emulsion Em-1 for the first layer (blue-sensitive emulsion layer) was substituted with the same amount of emulsion a (selected from the emulsions A to V in Table 4; refer to Table 5) and that the silver chloride bromide emulsion Em-2 for the third layer (green-sensitive emulsion layer) was substituted with the same amount of silver chloride bromide iodide b (a 1:3 mixture [by molar ratio of silver] of a large particle emulsion of cubes sensitized with gold and sulfur having an average grain size of 0.45 μm and a small particle emulsion of that having an average grain size of 0.35 μm; coefficients of variation in the grain size distribution for them were 0.10 and 0.08, respectively; each of the large and small particle emulsions contained 0.15 mole % of silver iodide near the surface of the grains and 0.4 mole % of silver bromide was locally contained on the surface of the grains).

Further, sample specimens 202–222 where the emulsion for the blue-sensitive emulsion layer in the sample specimen 201 prepared above was substituted with the emulsions B to V shown in Table 4 (refer to Table 5).

In order to check the photographic characteristic of the above-prepared sample specimens, the following experiment was carried out.

Gradation exposure for sensitometry was carried out for each sample specimen using a sensitometer for high illuminance (type HIE, trade name, manufactured by Yamashita Denso KK). An SP-1 filter (trade name, manufactured by Fuji Photo Film) was installed and an exposure to high illuminance was carried out for $10^{-4}$ second.

After the exposure, the color developing processing A was carried out.

Yellow coloring density of each sample after the processing was measured and a high-illuminance sensitivity by exposure for $10^{-4}$ second was determined. Sensitivity was stipulated by a reciprocal of exposed dose giving a coloring density of 1.0 higher than the lowest coloring density and was expressed by a relative value when sensitivity of the sample 201 coated with the emulsion A was defined as 100. Further, gradation (contrast) was determined from inclination of a straight line between the said sensitivity point and the sensitivity where the density was 1.5.

In addition, a gradation exposure for sensitometry was given by exposure for 0.1 second using a sensitometer for a medium-illuminance exposure (type FW; trade name; manufactured by Fuji Photo Film). A change (difference) in the density after 60 minutes from exposure at the area which corresponded to the exposure dose giving a density of 1.5 after 30 seconds from the exposure was determined and used as an index for a latent image stability. Accordingly, the smaller the figure, the smaller the change and thus the better the latent image stability.

The result is shown in the following Table 5.

TABLE 5

| Sample | Emulsion | Property at High intensity exposure | | Latent Image |
|---|---|---|---|---|
| Specimen | Used | Sensitivity | Contrast | Stability |
| 201 (Comp.Ex.) | A | 100 | 0.8 | 0.01 |
| 202 (Comp.Ex.) | B | 230 | 1.6 | 0.01 |
| 203 (Comp.Ex.) | C | 330 | 2.3 | 0.21 |
| 204 (Comp.Ex.) | D | 375 | 2.4 | 0.26 |
| 205 (Comp.Ex.) | E | 390 | 2.5 | 0.31 |
| 206 (Comp.Ex.) | F | 410 | 2.5 | 0.37 |
| 207 (Comp.Ex.) | G | 405 | 2.6 | 0.39 |
| 208 (Comp.Ex.) | H | 386 | 2.3 | 0.29 |
| 209 (Comp.Ex.) | I | 270 | 1.3 | 0.04 |
| 210 (Comp.Ex.) | J | 290 | 1.5 | 0.05 |
| 211 (This Invn.) | K | 351 | 2.4 | 0.08 |
| 212 (This Invn.) | L | 380 | 2.4 | 0.09 |
| 213 (This Invn.) | M | 395 | 2.5 | 0.09 |
| 214 (This Invn.) | N | 426 | 2.6 | 0.11 |
| 215 (This Invn.) | O | 410 | 2.5 | 0.13 |
| 216 (This Invn.) | P | 405 | 2.4 | 0.14 |
| 217 (Comp.Ex.) | Q | 423 | 2.6 | 0.20 |
| 218 (This Invn.) | R | 429 | 2.5 | 0.13 |
| 219 (This Invn.) | S | 435 | 2.5 | 0.08 |

TABLE 5-continued

| Sample | Emulsion | Property at High intensity exposure | | Latent Image |
|---|---|---|---|---|
| Specimen | Used | Sensitivity | Contrast | Stability |
| 220 (Comp.Ex.) | T | 300 | 1.7 | 0.04 |
| 221 (Comp.Ex.) | U | 310 | 1.7 | 0.05 |
| 222 (This Invn.) | V | 393 | 2.4 | 0.11 |

As is apparent from the results in the above Table 5, a high-illuminance sensitivity becomes high giving an image where contrast in gradation was obtained in the sample specimens of the present invention using a silver halide emulsion where $K_2[Ir(H_2O)Cl_5]$ was doped at the site where the silver chloride content of silver halide grains was 90% or more and $K_2[IrCl_6]$ was doped at the site where the Br content of silver halide grains was 40% or more. At the same time, the latent image stability was very good as well. On the contrary, in the sample specimens of Comparative Examples, it was insufficient for making the sensitivity high and the gradation to have contrast within a range where a latent image stability was good while it was not possible to give sufficient latent image stability when sensitivity and gradation were enhanced.

Example 6

Silver halide color photosensitive material sample specimen comprising the same layer composition as in Example 2 were made in thinner forms except that the respective emulsions in the first, third and fifth layers were substituted with those used in Example 5 respectively, and then the same experiment as in Example 5 was carried out for the said sample specimen. The result was the same as that in Example 5 and, even when the sample specimen made into a thin layer was subjected to an ultra-quick processing, the high-illuminance sensitivity could be made high and the gradation was made in a hard tone. At the same time, latent image stability was very good as well. Each of the sample specimens prepared was subjected to exposure to the same light as in the experiment in Example 5 and the color development processing was carried out by means of an ultra-quick processing according to the above-mentioned development processing B.

Example 7

Image formation was carried out by a laser scanning exposure using each of the sample specimens of Example 6.

The laser beam sources used were 473 nm which was taken out by wavelength transformation of an YAG solid laser (oscillating wavelength: 946 nm) having a semiconductor laser GaAlAs (oscillating wavelength: 808.5 nm) as an exciting light source by SHG crystals of $LiNbO_3$ having an inverted domain structure; 532 nm which was taken out by wavelength transformation of $YVO_4$ solid laser (oscillating wavelength: 1064 nm) having a semiconductor laser GaAlAs (oscillating wavelength: 808.7 nm) as an exciting light source by SHG crystals of $LiNbO_3$ having an inverted domain structure; and AlGaInP (oscillating wavelength: about 680 nm; manufactured by Matsushita Electric Industrial; type No. LN9R20).

Each laser beam of the above-mentioned three colors was made in such a manner that it was moved parallel to the scanning direction by a polygon mirror and successively scanned and exposed on the sample specimen. Changes in quantity of light of the semiconductor laser depending upon temperature was suppressed by keeping the temperature constant utilizing a Peltier element. Practically effective beam diameter was 80 $\mu$m, scanning pitch was 42.3 $\mu$m (600 dpi) and average exposure time per pixel was $1.7\times10^{-7}$ second.

After the exposure, the same color development processing B as in Example 6 was carried out whereupon similar result at high intensity exposure in Example 6 was achieved and, in a sample using a silver halide emulsion where $K_2[Ir(H_2O)Cl_5]$ was doped at the site where the silver chloride content of silver halide grains was 90 mole % or more and $K_2[IrCl_6]$ was doped at the site where the Br content of silver halide grains was 40 mole % or more, the high-illuminance sensitivity was high and the gradation was in a hard tone. In addition, the latent image stability was very good. In view of the above, the invention was found to be suitable for an image formation using a laser scanning exposure as well.

Example 8

Sample specimens were prepared by the same manner as in Examples 5–7 except that, in place of the ultraviolet absorbers UV-A and UV-B used in Example 5–7, the following UV-A' and UV-B' where only UV-4 was included as a part of a mixed composition therein was each substituted with the same mass of Uv-8 were used in the same mass for UV-A and UV-B respectively and then experiment, evaluation, etc. were carried out.

As a result, there was confirmed the same result as in Examples 5–7.

In accordance with the present invention, it is now possible to provide a silver halide emulsion where there is no reciprocity rule failure upon (super)high light intensity exposure (digital exposure) such as laser scanning exposure and which is highly sensitive and has coloring gradation contrast and also has little latent image sensitization. It is also possible to provide a silver halide color photosensitive material where there is no high-illuminance reciprocity rule failure upon (super)high intensity exposure (digital exposure) such as laser scanning exposure, and which is highly sensitive and has coloring gradation contrast, and also has little latent image sensitization and is able to form an image having a high contrast in a stable manner.

What is claimed is:

1. A silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by formula (I), (ii) the iridium compound (B) is represented by formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I) and (II) being:

$$[Ir(Y)_n(Xa)_m]^l \quad \text{Formula (I)}$$

wherein Xa is a halogen atom; Y is O or $H_2O$; and l, m and n are integers selected from ranges of from −2 to +3, from 1 to 5 and from 1 to 5, respectively; and $$[Ir(Xb)_6]^p \quad \text{Formula (II)}$$

wherein Xb is a halogen atom; and p is an integer selected from a range of from −2 to −3.

2. The silver halide emulsion according to claim 1, wherein the molar ratio [(I)/(II)] of the iridium compound represented by the formula (I) to the iridium compound represented by the formula (II) is 0.25–10.

3. The silver halide emulsion according to claim 1, wherein (i), (ii) and (iii) are respectively characterized by following conditions (iv), (v) and (vi):

(iv) the iridium compound (A) is a sixcoordinate complex which has an iridium as a central metal having at least one $H_2O$ as a ligand and is doped to the site where the localized silver chloride content is no less than 90 mole % in the silver halide grains;

(v) the iridium compound (B) is a sixcoordinate complex which has an iridium as a central metal having ligands selected from the group consisting of Cl, Br and I, and is doped to the site where the localized silver bromide content is no less than 40 mole % in the silver halide grains; and (vi) the silver halide grains have a site where the localized silver bromide content is no less than 40 mol %.

4. The silver halide emulsion according to claim 3, wherein the site at which the silver bromide content in the silver halide grains is no less than 40 mole % is formed by dissolving and sedimentation of fine grains of silver halide.

5. The silver halide emulsion according to claim 3, wherein the silver halide grains are silver chloride iodide bromide grains containing 0.02 mole % to 1 mole % of silver iodide.

6. The silver halide emulsion according to claim 4, wherein the silver halide grains are silver chloride iodide bromide grains containing 0.02 mole % to 1 mole % of silver iodide.

7. A silver halide photosensitive material comprising a support having disposed thereon at least one layer containing a silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by the formula (I), (ii) the iridium compound (B) is represented by the formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I) and (II) being:

$$[Ir(Y)_n(Xa)_m]^l \quad \text{Formula (I)}$$

wherein Xa is a halogen atom; Y is O or $H_2O$; and l, m and n are integers selected from ranges of from −2 to +3, from 1 to 5 and from 1 to 5, respectively; and $$[Ir(Xb)_6]^p \quad \text{Formula (II)}$$

wherein Xb is halogen atom; and p is an integer selected from a range of from −2 to −3.

8. The silver halide photosensitive material according to claim 7, wherein the molar ratio [(I)/(II)] of the iridium compound represented by the formula (I) to the iridium compound represented by the formula (II) is 0.25–10.

9. The silver halide photosensitive material according to claim 7, comprising at least three layers containing the silver halide emulsion, wherein at least one of the three layers is a yellow dye-forming coupler-containing silver halide emulsion layer, at least one of the three layers is a magenta dye-forming coupler-containing silver halide emulsion layer, and at least one of the three layers is a cyan dye-forming coupler-containing silver halide emulsion layer, and wherein (i), (ii) and (iii) are respectively characterized by following conditions (iv), (v) and (vi):

(iv) the iridium compound (A) is a sixcoordinate complex which has an iridium as a central metal having at least one $H_2O$ as a ligand and is doped to the site where the localized silver chloride content is no less than 90 mole % in the silver halide grains;

(v) the iridium compound (B) is a sixcoordinate complex which has an iridium as a central metal having ligands selected from the group consisting of Cl, Br and I, and is doped to the site where the localized silver bromide content is no less than 40 mole % in the silver halide grains; and (vi) the silver halide grains have a site where the localized silver bromide content is no less than 40 mol %.

10. The silver halide photosensitive material according to claim 9, wherein the site where the silver bromide content of the silver halide grains is no less than 40 mole % is formed by dissolving and sedimentation of fine grains of silver halide.

11. The silver halide photosensitive material according to claim 9, wherein the silver halide grains are silver chloride iodide bromide grains containing 0.02 mole % to 1 mole % of silver iodide.

12. The silver halide photosensitive material according to claim 10, wherein the silver halide grains are silver chloride iodide bromide grains containing 0.02 mole % to 1 mole % of silver iodide.

13. A silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by formula (I)', (ii) the iridium compound (B) is represented by formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I)' and (II) being:

$$[Ir(Y)_n(Xa)_m]^l \qquad \text{Formula (I)'}$$

wherein Xa is a halogen atom; Y is thiazole or substituted thiazole; and l, m and n are integers selected from ranges of from −2 to +3, from 1 to 5 and from 1 to 5, respectively; and $$[Ir(Xb)_6]^p \qquad \text{Formula (II)}$$

wherein Xb is a halogen atom; and p is an integer selected from a range of from −2 to −3.

14. The silver halide emulsion according to claim 13, wherein the molar ratio [(I)'/(II)] of the iridium compound represented by the formula (I)' to the iridium compound represented by the formula (II) is 0.25–10.

15. The silver halide emulsion according to claim 13, wherein the localized silver bromide layer is formed in a layered form surrounding the grains at an inner side or surface of the grains.

16. The silver halide emulsion according to claim 13, wherein the localized silver bromide phase in the grains is arranged such that at the side which is outside where the silver amount is more than 70%.

17. The silver halide emulsion according to claim 13, wherein the adding amount of the iridium compound (I)' is $1\times10^{-7}$ to $5\times10^{-6}$ mole per mole of silver halide.

18. The silver halide emulsion according to claim 13, wherein the silver halide grains are silver chloride iodide bromide grains containing 0.02 mole % to 1 mole % of silver iodide.

19. The silver halide emulsion according to claim 13, wherein the silver halide emulsion is a blue-sensitive emulsion.

20. A silver halide photosensitive material comprising a support having disposed thereon at least one layer containing a silver halide emulsion containing silver halide grains, with no less than 90 mol % of said silver halide grains being silver chloride and the silver halide grains containing at least one iridium compound (A) and at least one iridium compound (B), wherein (i) the iridium compound (A) is represented by the formula (I)', (ii) the iridium compound (B) is represented by the formula (II), and at least 50 mol % of the iridium compound (B) is present in a localized silver bromide phase where the localized silver bromide content is no less than 10 mol %, and (iii) the silver halide grains have a localized silver bromide phase where the localized silver bromide content is at least 5 mol % in a silver amount region where at least 5 mol % of total silver amount contained in the silver halide grains is present, with formulae (I)' and (II) being:

$$[Ir(Y)_n(Xa)_m]^l \qquad \text{Formula (I)'}$$

wherein Xa is a halogen atom; Y is thiazole or substituted thiazole; and l, m and n are integers selected from ranges of from −2 to +3, from 1 to 5 and from 1 to 5, respectively; and $$[Ir(Xb)_6]^p \qquad \text{Formula (II)}$$

wherein Xb is halogen atom; and p is an integer selected from a range of from −2 to −3.

21. The silver halide photosensitive material according to claim 20, wherein the molar ratio [(I)'/(II)] of the iridium compound represented by the formula (I)' to the iridium compound represented by the formula (II) is 0.25–10.

22. The silver halide photosensitive material according to claim 20, wherein the localized silver bromide layer is formed in a layered form surrounding the grains at an inner side or surface of the grains.

23. The silver halide photosensitive material according to claim 20, wherein the localized silver bromide phase in the grains is arranged such that at the side which is outside where the silver amount is more than 70%.

24. The silver halide photosensitive material according to claim 20, wherein the adding amount of the iridium compound (I)' is $1\times10^{-7}$ to $5\times10^{-6}$ mole per mole of silver halide.

25. The silver halide photosensitive material according to claim 20, wherein the silver halide grains are silver chloride iodide bromide grains containing 0.02 mole % to 1 mole % of silver iodide.

26. The silver halide photosensitive material according to claim 20, wherein the silver halide emulsion is a blue-sensitive emulsion.

* * * * *